US007228916B2

(12) United States Patent
Catlin et al.

(10) Patent No.: US 7,228,916 B2
(45) Date of Patent: Jun. 12, 2007

(54) EXPLOSION SUPPRESSION SYSTEM

(75) Inventors: Clive Adrian Catlin, Sheffield (GB); Bruce Carmichael Robertson Ewan, Bakewell (GB)

(73) Assignee: The University of Sheffield (GB)

( * ) Notice: Subject to any disclaimer, the term of this patent is extended or adjusted under 35 U.S.C. 154(b) by 89 days.

(21) Appl. No.: 10/363,080

(22) PCT Filed: Aug. 28, 2001

(86) PCT No.: PCT/GB01/03843

§ 371 (c)(1),
(2), (4) Date: Jul. 29, 2003

(87) PCT Pub. No.: WO02/18016

PCT Pub. Date: Mar. 7, 2002

(65) Prior Publication Data

US 2004/0020666 A1 Feb. 5, 2004

(30) Foreign Application Priority Data

Aug. 29, 2000 (GB) ..... 0021117.7

(51) Int. Cl.
*B05B 1/20* (2006.01)

(52) U.S. Cl. ..... 169/46; 169/54; 169/56; 169/70; 169/9

(58) Field of Classification Search ..... 169/54, 169/28, 19, 45, 46, 64, 70, 56; 454/170; 102/303

See application file for complete search history.

(56) References Cited

U.S. PATENT DOCUMENTS

| | | | | |
|---|---|---|---|---|
| 1,539,091 | A * | 5/1925 | Krantz | 169/56 |
| 2,961,049 | A * | 11/1960 | Toulmin, Jr. | 169/56 |
| 3,692,118 | A * | 9/1972 | Yao | 169/47 |
| 3,960,217 | A * | 6/1976 | Liebman et al. | 169/64 |
| 4,284,144 | A | 8/1981 | Liebman et al. | |
| 5,088,560 | A * | 2/1992 | Fawal | 169/28 |
| 6,782,792 | B1 * | 8/2004 | Edberg et al. | 89/36.04 |

FOREIGN PATENT DOCUMENTS

| | | |
|---|---|---|
| DE | 1 708 116 | 4/1971 |
| DE | 4236904 A1 | 7/1993 |
| DE | 19608414 A1 | 11/1996 |
| EP | 0 488 536 A1 | 6/1992 |
| GB | 2202440 A | 9/1988 |
| GB | 2314614 A | 1/1998 |
| RU | 2004825 C1 | 7/1991 |
| WO | WO 96/28255 | 9/1996 |

* cited by examiner

*Primary Examiner*—Dinh Q. Nguyen
(74) *Attorney, Agent, or Firm*—Sheridan Ross P.C.

(57) ABSTRACT

Explosion suppresant container, for use in suppression of deflagrative explosions and other like events involving combustion associated with rapidly moving gases, comprising a container which, in use, contains suppressant, an outlet through which suppressant can exit the container progressively and be atomised into droplets and an inlet thorugh which air can enter the container and the shape of said container being such that, in use, the pressure of the explosion wind in the region of the outlet is less than that in the region of the inlet so that suppressant is driven out of the outlet into the explosion wind.

45 Claims, 28 Drawing Sheets

EXPLOSION SUPPRESSION SYSTEM

This invention relates to a method, and various apparatuses which embody the method, for suppressing, extinguishing or inhibiting combustion associated with rapidly moving gas, such as occurs in an explosion, through the dispersal of a suppressant.

Deflagrative Explosions

The type of event with which the present invention is particularly concerned is a deflagrative explosion which involves the combustion of a flammable mixture typically a mixture of oxidant, such as gaseous air or oxygen, and a flammable material such as a hydrocarbon, whether in gaseous, liquid droplet or solid particulate form. In a deflagrative explosion a flame propagates through the flammable mixture, giving rise to a temperature increase and volumetric expansion which cause the flammable mixture ahead of the flame to be displaced. This in turn causes the atmospheric pressure to increase above its ambient value. The difference between this explosion pressure and the ambient atmospheric pressure is referred to as over-pressure. The corresponding flow of flammable mixture ahead of the flame is termed "the explosion wind". Because of the explosion wind, the flame travels beyond the initial extent of the flammable mixture. Despite that definition, however, in the context of the present invention the expression "explosion wind" should also be understood to include rapidly moving gas in other combustion events, and may include flame.

Deflagrative explosions can be categorised as unconfined, confined, and/or partially-confined. An unconfined explosion is one in which the flame propagates through a region which is both free of obstructions and is not enclosed by solid surfaces. A confined explosion is one in which the flame propagates through a region which is enclosed by solid surfaces. Typically there are vents in the enclosing surfaces through which the explosion wind can escape, such as the windows and/or doorways in a building. Thus venting of flammable mixture from a confined explosion can cause an explosion hazard outside the confined region. A partially-confined explosion will refer to one in which the flame propagates through obstructions such as process plant, pipe work, fittings, equipment or furniture. Partially confined explosions can also be confined explosions such as can occur in an offshore platform module, engine room or process plant house where obstacles are contained within walls, floors and/or roofs. Such explosions will be referred to as both confined and partially-confined explosions.

However, while not fully explored, there is no reason to suppose that the method and apparatus of the present invention should not have beneficial effects in other situations. For example, highly explosive solid material detonates with a resulting pressure wave, followed by an expanding fireball. The gases in the fireball could be cooled, and/or afterburning could be suppressed. Jet fires are another example, usually caused by a puncture in a pressurised vessel or pipe carrying flammable medium which is burning on exit from the puncture. A particular problem with jet fires is that they tend to be relatively long lasting, compared with other combustion events such as explosions, and persistent high temperatures need to be accommodated. The invention is therefore not limited by the type of event other than that the problem to be solved involves rapidly moving gas. It would be desirable to provide simple and effective suppression apparatus and methods that served against these events also.

Pressure-Rise-Time

The time between first arrival at the explosion suppression apparatus ("the appliance") of an over-pressure and the later arrival of the flame shall be referred to as the pressure-rise-time (δ seconds). The pressure-rise-time defines the time period over which the explosion wind interacts with the appliance. The pressure-rise-time differs between explosions, the actual time depending upon the distance of the appliance from the ignition position and the propagation speed of the flame. If the appliance is a distance $R_F$ metres from the ignition point, the speed of the leading front of the pressure wave is $S_S$ m/s and the flame speed is $S_F$ m/s then the pressure-rise-time δ is given by the equation $$\delta = R_F \times [(1/S_F) - (1/S_S)] \text{ seconds.}$$

Consider an explosion in a flammable mixture comprising mainly air and for example take Ss to be the speed of sound in ambient air, namely $S_S$=333 m/s. Consider an appliance situated 20 meters from the ignition point. A flame with an average speed of 50 m/s generates a pressure-rise-time of 340 milliseconds at the appliance. An appliance situated 5 meters from the ignition point witnesses a pressure-rise-time of 85 milliseconds.

Suppressants and Particle Diameters

Suppressants are dispersed by explosion suppression devices and act to reduce the rate of combustion and/or cool the combustion products by a combination of inerting, inhibiting or extracting heat from the combustion process. Typical suppressants are water, chlorobromethane (Halon 1011), mono-ammonium phosphate based dry powder (MAP) and rock dust, the latter typically being used for coal-dust explosions. The suppressant may have several components such a high latent heat liquid, such as water, to which various particles or chemicals have been added. It should be noted that some suppressants employ chemicals which can be harmful to humans and the environment.

To be effective the suppressant must be in an atomised form at the time it meets the flame. Atomised will be used to describe a physical state of the suppressant in which it is comprised of discrete particles and/or droplets. The particles must be sufficiently small to have a suppression effect in their short passage time through the reaction zone of the flame. This is described for the case of water as a suppressant by Van Wingerden et al in the Journal of Loss Prevention in the Process Industries, 1995, 8(2):61-70. Reducing the surface tension can aid the production of small diameter droplets. In practice there may be scope for introducing chemical or particle additives to water to reduce its surface tension without compromising its suppressant properties. The suppressant particle diameter ($d_P$ meters) necessary to suppress the flame can also be determined from experimental studies of flammability limits as described by Amrogowicz and Kordylewski in Combustion and Flame, 1991, 85:520-522. Van Wingerden argues that water droplets need to be a few tens of microns in diameter for them to be an effective suppressant for a flammable mixture of hydrocarbon and air. To put this requirement in context it is in practice very difficult to generate droplets in this size range and requires the use of specialised atomising nozzles as described by Lefebvre in Atomization and Sprays, 1989, ISBN 0-89116-603-3. One type of atomiser capable of producing such small droplet sizes is the air-blast atomiser which works by subjecting a liquid jet or sheet to a high velocity gas stream.

Suppressant Concentration

The concentration or volume fraction of the suppressant in the flammable mixture determines the degree of flame suppression. This can vary from a small reduction in the burning rate of the flame to flame extinction. The target concentration for a particular application is best determined from relevant experimental studies. For example Catlin, Gregory, Johnson and Walker in Transactions of the Institute of Chemical Engineers, 1993, 71B:101-111 used field-scale explosion experiments to infer that a water volume fraction between $5\times10^{-4}$ 0.05 percent and $3\times10^{-4}$ (0.03 percent) is able to substantially suppress an explosion in a flammable mixture of natural gas and air.

Dispersal

The suppressant is stored in a container from which it is released and then disperses into the atmosphere. Dispersed will refer to the state of the suppressant in which it is both atomised and mixed with the flammable mixture in sufficient concentration to effectively suppress the flame.

Activation-Time

The time between the onset of the explosion and the time when the appliance starts to release suppressant into the atmosphere will be referred to as the activation-time ($\Delta T$ seconds). This is an important appliance design parameter since too long a activation-time could result in the explosion causing fatality or damage before suppression is realised.

Dispersal-Time

The time between the onset of the explosion and the time when sufficient suppressant has been dispersed into the atmosphere to effectively suppress the explosion will be referred to as the dispersal-time. The dispersal-time is an important appliance design parameter since too long a dispersal-time could result in the explosion causing fatality or damage before the suppressant has been dispersed.

Active or Passive Appliances

Explosion suppression appliances can be categorised as either active or passive. Active appliances rely upon a detection system which initiates the release of the suppressant. Detection may be for flammable mixture, flame and/or an over-pressure. Passive appliances are ones whose presence alone is sufficient to achieve explosion suppression. Passive appliances disperse the suppressant through the action of the explosion pressure and/or explosion wind.

Types of Suppression Appliance

Suppression appliances can be categorised into four types depending upon the primary mechanism used to disperse, and for liquid suppressants atomise the suppressant.

The four dispersal mechanisms are respectively:

a) High Pressure Dispersal, as described by Moore in Transaction of the Institute of Chemical Engineers, 1990, 68 Part B: 168-175 and patent application GB-A-2202440;

b) Pumped Dispersal, as described by Van-Wingerden et al cited earlier and in patent application WO-96/28255;

c) Gravity Dispersal, as described in patent and patent application nos DE19608141A, RU2004825C, DE4236904A and U.S. Pat. No. 4,284,144A; and d) Explosion Dispersal, such as in UK patent application no GB2314614A.

Existing Methods Used to Atomise Liquid Suppressants

The methods used to atomise liquid suppressants differ between the types of suppression appliance.

High pressure dispersal appliances generate droplets by passing the liquid through a nozzle at high velocity and/or by generating bubbles within the liquid to produce an effervescent effect. Such high pressure dispersal appliances are capable of producing very small droplets as discussed by Lefebvre cited earlier.

Pumped appliances as described by Catlin, Gregory, Johnson and Walker cited earlier employ conventional fire nozzles to generate primary droplets whose diameters are in the order of 500 micron to 1000 micron. Some pumped appliances as described in patent application WO_96_28255 employ special spray devices to generate large primary droplets in the order of 1000 micron. According to Van Wingerden et al cited earlier such droplets are too large to be an effective suppressant. The suppression capability of such pumped appliances is claimed by Van Wingerden et al cited earlier to be due to primary droplet break-up, the smaller secondary droplets having the suppression effect. The secondary droplets are formed by the relative motion of the gas over the surface of the primary droplet as described by Clift, Grace and Weber in Bubbles, Drops and Particles, 1978, ISBN 012176950x and Pilch and Erdman, in International Journal for Multiphase_Flow, 1987, 13(6):741-757.

Gravity dispersal appliances, such as used in mines, release the suppressant from containers. The suppressant first breaks up into large primary droplets whilst falling under the influence of gravity and secondly into smaller droplets through the action of the explosion wind. A very important additional contribution for use in mines is the wetting of the flammable material which is in the form of coal dust particles on the tunnel floor. Wetted coal becomes air-borne under the action of the explosion wind and will either be coated by the liquid suppressant or else accompanied by suppressant droplets. Either situation will have a suppression effect on the flame.

Explosion dispersal appliances as described in UK patent application number GB2314614A work by the action of the explosion. The explosion pressure ruptures containers filled with aerosol-forming liquid which release small droplets into the atmosphere.

Existing Methods Used to Disperse the Suppressant

High pressure and pumped appliances rely upon the spray distribution characteristics of the nozzles to ensure that the suppressant particles are mixed adequately with the flammable mixture.

Gravity appliances rely primarily upon mixing of the suppressant with the flammable dust on the tunnel floor and secondly upon the effects of turbulence in the explosion wind. Turbulence is formed in the explosion wind and acts to transport atomised material from the floor into the full cross-section of the tunnel. It may take several tunnel heights or widths downstream of the appliance before effective mixing is achieved. The position where suppression is achieved will depend on the specific characteristics of the appliance.

Explosion dispersal appliances rely entirely upon the interaction of the explosion over-pressure or explosion wind with the appliance.

Existing Methods Used to Achieve Effective Dispersal-Times

The large driving pressure of high pressure dispersal appliances enables the suppressant to be dispersed in a short time-scale, namely tens to hundreds of milliseconds as described by Moore cited earlier. The short dispersal time is essential for this type of active suppression appliance because they are activated during the explosion.

Pumped appliances take longer, in the order of 1,000 milliseconds, since the pump takes time to reach the full delivery rate and the droplets take time to permeate the target region.

The dispersal-time for a gravity dispersal appliance first depends upon the time taken for the container to rupture. For a passive appliance this will be caused directly by the explosion. For an active appliance this will be determined by the release system. The suppressant then falls to the floor whilst also being dispersed in the explosion wind. The fall time ($T_{FALL}$ seconds) can be estimated by assuming the suppressant starts its fall after release from the container with no vertical velocity and the aerodynamic drag forces can be neglected. The time interval to fall a height of Z meters is then given by the equation $$T_{FALL}=(2\ Z/g)^{1/2}\ \text{seconds}$$

where g ($m/s^2$) is the acceleration due to gravity.

Thus taking g to have an approximate value of 10 $m/s^2$ the liquid would take approximately 775 milliseconds to fall a height of 3 meters. To this must be added the rupture or release time of the container.

Siting of Appliances

The siting of an appliance is an important design factor influencing the effectiveness, ease of installation and cost of a system.

For high pressure dispersal appliances the region in which they are effective lies in line and to the sides of the nozzle exit direction. Typically such appliances are mounted adjacent to the walls or roof of the region. If adequate coverage cannot be achieved by one appliance then a number may need to be installed.

Pumped dispersal appliances must fill the whole region where suppression is required with suppressant. Thus many individual sources of suppressant are required which are sited sufficiently close to one another to give complete floor coverage. Typically these are spray devices mounted at ceiling level. Local area floor coverage is not favoured because displacement of the suppressant during the explosion from its original position may prevent suppression in the region where the appliance is installed.

Gravity dispersal appliances are typically mounted at roof height. Many appliances are installed at regular intervals along the tunnel to ensure that the flame, whose ignition position is unknown, meets the fully dispersed suppressant from at least one appliance.

The siting of explosion dispersal appliances depends crucially upon their activation time, dispersal-time and where the suppressant has been dispersed at the time of flame arrival. These factors all depend upon the specific characteristics of the appliance.

Limitations of the Different Appliance Types

High pressure dispersal appliances have a number of limitations. First the size of the region in which they are effective is dependant upon the volume of suppressant in the containment vessel. Larger vessels take longer to discharge their contents. Thus there can be limitations when using this type of appliance in large regions when a large device is required and the dispersal time is too long to be effective. Second these appliances rely upon driving pressure to force the suppressant to penetrate the explosion flame. Thus they can suppress the flame inside the confining surfaces of a confined explosion where the explosion wind velocities are lower than that of the dispersing suppressant. They are less effective for explosions with high wind velocities such as are generated by venting from a confined explosion and unconfined and partially-confined explosions. In these latter cases the suppressant can be displaced away from the release point and may not suppress the explosion in the vicinity of the appliance. Third they are active appliances and require a detection and activation system. Fourth they run the risk of premature activation, by say a precursor explosion with a low over-pressure. Once fired these appliances cease to provide explosion suppression capability and require a substantial time to reprime. For a bottled system the bottles would all need replacing, for a heated system the liquid would need refilling and reheating.

Pumped dispersal appliances have a number of limitations. First the appliances need to provide complete floor coverage to ensure protection and therefore require many spray sources and associated supply piping. Second the dispersal time is in the order of 1000 milliseconds and therefore greater than the pressure-rise-time for the majority of relevant explosions. There is the risk therefore that activation occurs too late to suppress the explosion. Third they are active appliances and require a detection and activation system. Fourth the deluge water could interact with electrical systems to cause a spark and initiate an explosion which would not otherwise have occurred. Fifth, the deluge water can inhibit the escape of personnel by impairing their vision.

Gravity dispersal appliances have a number of limitations. First the dispersal time is in the order of 1000 milliseconds and therefore greater than the pressure-rise-time for the majority of relevant explosions. Second, they are primarily effective against dust explosions in which flammable material lies on the floor of a tunnel. Third, suppression of the flame is only likely to occur at a distance of several tunnel heights or widths down-stream of the appliance.

Explosion dispersal appliances have the advantage that they do not require a detection or activation system. Their advantages or disadvantages relative to other appliances depend upon their particular dispersal characteristics. In particular the activation-time, dispersal-time, the ability to generate sufficiently small particle/droplet sizes and the location relative to the appliance where the suppressant is dispersed in effective concentrations.

It is an object of the present invention to provide an explosion suppression system which seeks to alleviate the above-described problems.

SUMMARY OF THE INVENTION

According to a first aspect of the present invention there is provided an explosion suppressant container, for use in suppression of deflagrative explosions and other like events involving an explosion wind, comprising a container which, in use, contains suppressant, an outlet through which suppressant can exit the container progressively and be atomised into droplets and an inlet through which air can enter the container, the shape of said container being such that, in use, the pressure of the explosion wind in the region of the outlet is less than that in the region of the inlet so that suppressant is driven out of the outlet into the explosion wind.

Significant advantages are offered by this container over conventional explosion suppression systems. The suppressant is released from the container entirely automatically as a result of the forces applied by the explosion wind. There is therefore no need for any kind of actuation device and consequently the activation time can be minimised.

Furthermore, the suppressant leaves the container progressively during an explosion so that the available suppressant is not released en masse as is the case with gravity dispersal systems, for example. The body of the container is preferably of sufficient strength to withstand direct exposure to the explosion wind so that the suppressant is only released through the outlet, in a controlled manner. This means that dispersal of the suppressant can occur continuously over the period between arrival of the explosion wind and arrival of the explosion flame so that a concentration of suppressant is released sufficient to effectively suppress the flame and explosion in the near vicinity and/or downwind of the container.

In relation to high explosive events, the container should be arranged strong enough to withstand the effect of the shock wave that precedes the fireball, as well as the explosion wind that follows the shock wave and which activates the device, as with deflagrative explosions.

In relation to jet fires, a potential further problem with them is that they tend to be enduring. While the present invention has fast reaction time, to cater effectively for jet fires, it would be necessary to incorporate a replenishment system to keep the container charged with suppressant while the jet fire remains active. Since the reaction time required for this is much longer than to commence suppression, it should not be a significant problem to provide an activation mechanism to initiate the replenishment of suppressant before the container is fully depleted.

Preferably, the container further comprises an air flow inhibitor for inhibiting air flow within the body between said outlet and said inlet. This facilitates the exit of suppressant from the container.

Preferably, the container further comprises a flow guide within the body for: determining the flow route of suppressant within the body. This assists in ensuring the suppressant leaves the container in a controlled manner, in terms of direction, velocity and volume. For example, the flow guide could be used to cause the suppressant to leave the outlet at a shallow angle so that the suppressant travels close to the surface of the container.

In a preferred form, the flow guide and air flow inhibitor are integral with one another. The container may be more straightforward to manufacture if a single part thereof performs both of these functions.

Preferably, the flow guide comprises a channel, spout or the like depending from the outlet into the body below the normal surface level of suppressant.

Alternatively, the flow guide comprises a baffle plate depending from the internal surface of the body below the normal surface level of suppressant.

Preferably, the container has a plurality of outlets and/or inlets. Ideally, one or more of said outlets can serve as one or more of said inlets.

Preferably, the body is substantially symmetrical in cross-section about a plane intermediate said outlet and said inlet, thus enabling the container to respond to an explosion wind approaching from either end of the container. This has the advantage of enabling the container to be effective in dealing with explosions approaching from two possible directions 180 degrees apart. Otherwise, if an explosion is likely to approach from two possible directions, two sets of containers each with the appropriate orientation would be required.

Preferably, the container further comprises a spoiler or the like mounted on the external surface of the container in order to enhance the dispersal and/or mixing and/or atomisation of suppressant exiting the container. Indeed, the inlet may be on a leading edge of the body in a stagnant space for an anticipated explosion wind and caused by the spoiler. Here, the term "stagnant space" means a region near the upstream outer surface of the container where the gas velocity is much lower than that in the far upstream wind, and where the kinetic energy of the upstream wind is converted into surplus pressure. In any event, by the term "stagnant space" used in this specification is meant a region near the container whose air pressure is not depleted by the explosion wind to the same extent as other regions near the container.

Preferably, the external shape of the container includes a step or the like which, in use, increases turbulence and generates a shear layer in the explosion wind which enhances the dispersal and mixing of the suppressant.

In a preferred embodiment, the inlet and/or outlet is covered by a friable membrane which normally retains suppressant in the container but which ruptures when exposed to an explosion wind to allow suppressant to exit the container. This allows the container to be mounted in an orientation other than with the outlet and inlet uppermost.

In a further preferred form, the body further comprises flexible or moving parts therein whose position changes as suppressant is drawn from the container so as to regulate the suppressant flow. Ideally, said flexible or moving parts comprise a valve arrangement. Alternatively, said flexible or moving parts comprise a pivotable plate.

Preferably, the container is rotatable under the influence of the forces exerted by the explosion wind so as to orientate the inlet and outlet with respect to the explosion wind. Again this reduces the number of containers required to anticipate the direction of an approaching explosion wind by enabling containers to rotate "into" the explosion wind, for maximum effect.

In a preferred form, suppressant is normally retained within the body by means of a valve at the inlet, the valve being openable by the forces exerted by the explosion wind to allow air into and hence suppressant out of the body.

Preferably, the container further comprises suppressant supply inlets and/or outlets which enable the suppressant to be topped up and/or replenished and/or forced into the body. Although the apparatus already has the advantage of releasing the suppressant contained within the body in a progressive manner, this advantage can be supplemented by providing a supply of suppressant directly into the container, allowing suppressant to be released for as long as is required (rather than until the reservoir of suppressant in the body is exhausted).

Preferably, the body is elongate in the direction of anticipated explosion wind, said outlet being on or near a leading edge of the container, where air pressure is relatively low in an explosion wind, and said inlet is on or near a trailing edge of the container, where air pressure is relatively high in the explosion wind The container may have an internal partition confining suppressant to an upwind end of the body, and linking the air inlet to the suppressant, whereby the flow path for suppressant is shorter.

Cowlings are preferably disposed around the air inlet to create stagnant air in an explosion wind. Said body may be short in the direction of anticipated explosion wind. In this event, said outlets are preferably in front of and offset laterally with respect to said inlets to prevent suppressant exiting the outlet from entering the inlets.

The body is preferably shaped behind the or each outlet to increase the surface area of the body downwind of the outlet and so as to increase suppressant atomisation rate. The body may be undulating with ridges formed behind and extending from the or each outlet.

A funnel can be connected to the inlet. The funnel can be relatively large, there being provided a plurality of outlets along the breadth of the container supplied with inlet air by said funnel. Said funnel may comprise an open ended tube whose ends face in two possible directions of anticipated explosion wind, a member being displaceable in said tube to open and close ports adjacent each end of the tube in dependence upon said explosion wind direction, the ports each supplying a duct to said inlet. The member may be a ball.

A conduit is preferably provided from said inlet at a stagnant region of the container for an anticipated explosion wind, said conduit connecting said region with an internal space of the body above said suppressant and on the side of said air flow inhibitor remote from the outlet.

Said conduit may have a branch terminating at said outlet and arranged to direct air across the outlet in an explosion wind to assist atomisation of the suppressant exiting the outlet.

The container may be pivoted about a horizontal axis and is provided with a tail plane to align with the explosion wind, whichever direction it comes from, and wherein both the inlet and outlet are above suppressant level when in a normal attitude in no explosion wind.

A conduit may instead be provided from said inlet at a stagnant region of the container for an anticipated, vertically upward, explosion wind, said conduit connecting said region with an upper internal space of the body, which space is above said suppressant in the absence of an explosion wind, a closed cup surrounding said conduit and opening in a lower internal space of the body, said outlets opening from the upper internal space.

In this arrangement, the body may have a small cross section along the length of said conduit, opening into a larger cross section in said upper space.

According to a second aspect of the invention, there is provided apparatus for use in suppressing deflagrative explosions comprising a plurality of explosion suppression containers as described in any of the preceding paragraphs.

Preferably, the containers are arranged in an array so as to optimise the overlap and mixing of suppressant exiting adjacent containers.

Preferably, the array of containers is mounted within a frame.

Preferably, the apparatus further comprises aerodynamically smooth guide means which converge the explosion wind on approaching the containers so as to increase velocity of gas passing the containers.

Preferably, the apparatus further comprises turbulence-generating means which enhance the dispersal and mixing of the suppressant and thereby the suppressant capability of the apparatus. Ideally, said turbulence-generating means have a bluff downwind profile.

Preferably, the apparatus further comprises a friable wall within which the array of containers is mounted and which friable wall can be ruptured, in use, by the explosion wind. This has the advantage of allowing the apparatus to normally be hidden from view and protected from normal environmental effects.

Preferably, the apparatus further comprises a suppressant circulation system for supplying suppressant to the containers which, ideally, includes one or more reservoirs outside the containers where suppressant can collect. The suppressant circulation system could be mounted within the frame of the apparatus.

Preferably, the frame contains a series of cascades down which suppressant can fall under gravity and thereby provide a slow replenishment flow.

According to a third aspect of the invention, there is provided a method of suppressing deflagrative explosions using apparatus as described in any of the preceding paragraphs.

BRIEF DESCRIPTION OF THE DRAWINGS

Specific embodiments of the invention will now be described, by way of example only, with reference to the accompanying drawings in which:

Referring to FIGS. 1 and 2, the container 1 has an elongate body 2 which, in use, is intended to be located in the path of the explosion wind. The body 2 has a uniform lateral cross-section and the solid outer structure of the body has sufficient strength to be able to withstand the gas dynamic loading caused by an explosion wind (indicated by arrows E). The body 2 is hollow so that it can hold the required volume of suppressant 5. The container has a plurality of outlet apertures 3 and air inlet apertures 4, which extend along the length of the elongate body 2. These apertures may have any shape and for example might be slots and/or circular holes. The requirement is simply that the internal shape of the body 2 must provide flow routes whereby the suppressant can exit outlets 3 and air can enter the body 2 through the inlets 4.

Figure 1:
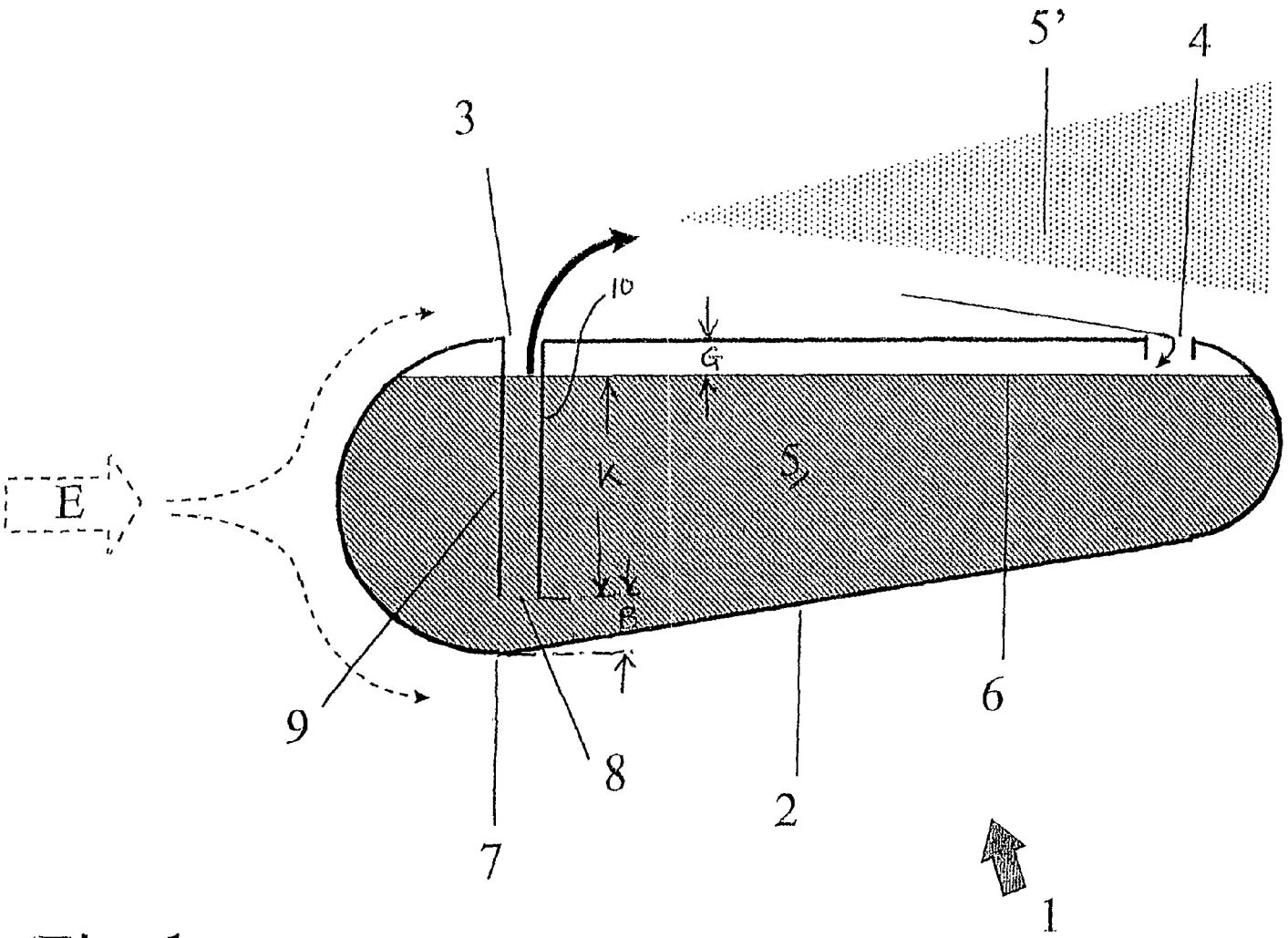
FIG. 1 shows a lateral cross-section of a container with the suppressant flowing out and being dispersed in atomised form by the explosion wind.

In order for this to occur, air is preferably inhibited from flowing directly between the air inlet 4 and the outlet 3. It is essential that the gas pressure at the air inlet 4 is greater than that at the outlet 3 so as to cause suppressant to be ejected from the body 2. To achieve this, the external shape of the container 1 is such as to encourage a higher gas velocity and a lower gas pressure in the region of the outlet relative to that at the downstream air inlet. The difference between the pressures at the inlet and outlet causes suppressant to flow from the container. The higher gas velocity in the vicinity of the outlet 3 disperses the suppressant 5 and, if it is liquid-based (e.g. water), atomises the suppressant 5 into small droplets 5' as shown in FIG. 1.

Furthermore, the container 1 also includes a flow guide 9 which, as illustrated in FIG. 1, is in the form of a channel or spout (shown in section in FIG. 1), depending from the outlet 3 into the body of the container and extending along the length of the body. The intake 8 of the flow guide 9 must be situated below the normal surface level 6 of the suppressant. In this way, the suppressant is forced to travel up the flow guide 9 in order to exit the outlet 3. Furthermore, the wall 10 of the flow guide acts as an air flow inhibitor, preventing air from flowing directly from inlet 4 to outlet 3.

The flow route or flow path extends into the body 2. The innermost point of the outlet flow route is at a depth K (m) below the normal surface level 6 of the suppressant (i.e. the initial level before any of the suppressant has been dispersed). The initial level of the suppressant is a distance G (m) below the outlet 3. The intake point 8 for the suppressant outflow route is a distance B (m) above the deepest point of the container 7. Thus the distance D (m) between the suppressant outlet 3 and the deepest point of the container 7 is given by D=G+K+B. The volume of suppressant that can be drawn from the container during the explosion will depend upon the depth K.

A container must be designed to meet several requirements as summarised below. The equations are approximate and do not guarantee that the apparatus will be effective. Tests are required to validate the effectiveness of the apparatus and are preferably conducted under representative explosion conditions.

It is essential that the time taken for the suppressant to leave the container and reach an effective mixed state should be less than the time the flame takes to propagate from its ignition position to the apparatus. This requirement will be dependent upon both the transient dynamics of the explosion and the suppressant.

First consideration is whether the outlet route involves an increase in height and if so the pressure forces causing the flow must be much greater than those due to the hydrostatic head caused by gravity.

Second the suppressant passes through a transient startup phase of duration equal to the activation-time (ΔT seconds) during which it is first accelerated from rest and then flows along the outlet route. Preferably the activation-time is substantially less than the time the flame takes to propagate from its ignition position to the apparatus. The suppressant dynamics in turn depend upon the specific shape and size of the containers.

Third it is preferable that flame suppression occurs in the immediate vicinity of the apparatus. It is necessary therefore that the suppressant is released continuously up to when the flame arrives at the apparatus. The holding capacity of the containers must therefore exceed the accumulated volume flow from the containers over the relevant time period, namely the pressure-rise-time.

Note that the following equations apply only to a liquid-based suppressant and are not valid if the suppressant is a dry powder. It is, however, possible that the container of the present invention may be used with a powder or particulate suppressant.

The time (ΔT sec) taken by the suppressant to accelerate from rest to when it starts to flow continuously from the container at its maximum flow rate $U_S^{MAX}$ can only be determined by detailed theoretical and/or experimental analysis. Relevant theoretical methods are computational fluid dynamics as described by Ferziger and Perié, in Computational Methods for Fluid Dynamics, 1996, ISBN 3-540-59434-5. Experimental methods might involve very high framing rate cine or video photography or else anemometry as described by Bruun in Hot-wire Anemometry: Principles and Signal Analysis, 1995, ISBN 0198563426.

The most important parameters can however be identified from the following dimensional analysis. It is assumed that the effects of the gas and liquid viscosities are negligible and that the explosion wind at the-apparatus varies with time in a manner independent of the apparatus. Consider the fluid at rest. The principal physical parameters determining ΔT are the maximum stagnation pressure ($\Delta P_A^{MAX}$ N/m$^2$) associated with the explosion wind, the pressure-rise-time (δ sec), the suppressant density ($\rho_S$ kg/m$^3$), a characteristic dimension D (m) say corresponding to the depth of the container and the acceleration due to gravity (g m/s$^2$). The stagnation pressure is related to the gas density ($\rho_A$ kg/m$^3$) and maximum gas velocity ($V_A^{MAX}$ m/s) by the equation $$\Delta P_A^{MAX}=\tfrac{1}{2}\rho_A(V_A^{MAX})^2.$$

The dimensionless group ($N_1$) describing the effect of gravity relative to the stagnation pressure is given by the equation $$N_1=(\rho_S gD)/\Delta P_A^{MAX}.$$

If the effect of gravity is negligible, namely $N_1<<1$, the only remaining dimensionless group ($N_2$) is given by $$N_2=(D/\delta)/(\Delta P_A^{MAX}/\rho_S)^{1/2}$$

and the dimensionless activation time ΔT* (ΔT*=ΔT/δ) is then only dependent upon $N_2$ and the shape of the container. This result supports the earlier description of the relevant processes by confirming that ΔT is both dependent upon parameters describing the container and the explosion wind. A very small value of $N_2$, namely $N_2<<1$, indicates that the suppressant will respond on a much shorter time-scale than that of the explosion, or equivalently that the activation-time is substantially less than the pressure-rise-time (ΔT<<δ). A very small value of $N_2$ therefore also suggests that the suppressant will have started to disperse from the container before flame arrival. This conclusion can only be confirmed however by more detailed theoretical and/or experimental analysis. A more accurate formula for ΔT is presented in the following.

Approximate equations for the quasi-steady flow rate $U_S$ of the suppressant after the start-up period are obtained by assuming that inertial effects in the gas and suppressant are negligible.

The gas velocities passing the liquid outlet ($U_{AO}$ m/s) and air inlet ($U_{AI}$ m/s) points can then be related to the upstream approach velocity ($V_A$ m/s) by two proportionality factors $\alpha_O$ and $\alpha_I$. Thus $$U_{AO}=\alpha_O V_A \text{ and } U_{AI}=\alpha_I V_A.$$

By applying the principle of Bernoulli as described by Batchelor in An Introduction to Fluid Dynamics, 1991, ISBN 0-521-09817-3 the pressure difference ($P_A^{DIFF}$ N/m$^2$) between the gas at the liquid outlet and air inlet is given in terms of the density of the gas ($\rho_A$) by the equation $$P_A^{DIFF}=\tfrac{1}{2}\rho_A C_A (V_A)^2.$$

The constant $C_A$ is determined by the external shape of the container and is related to the two velocity proportionality factors by the equation $$C_A=\{(\alpha_O)^2-(\alpha_I)^2\}.$$

For some applications the air intake is at the upstream stagnation point when $U_{AI}=0$ and, therefore, $C_A=(\alpha_O)^2$.

The quasi-steady outflow velocity of the suppressant ($U_S$ m/s) will also be related to the pressure difference and the suppressant density ($\rho_S$) by the equation $$P_A^{DIFF}=\tfrac{1}{2}\rho_S C_S (U_S)^2.$$

$C_S$ is a suppressant discharge coefficient determined by the internal shape of the container. By equating the two relationships for $P_A^{DIFF}$ the quasi-steady outflow velocity of the suppressant is determined by the equation $$U_S=[(\rho_A C_A)/(\rho_S C_S)]^{1/2} V_A.$$

An explicit formula relating ΔT to $N_2$ can be determined as follows. First define the activation time ΔT in terms of the average acceleration rate $A_S$ (m$^2$/s) of the suppressant, namely $$\Delta T=U_S^{MAX}/A_S.$$

which in turn is related to the pressure difference $P_A^{DIFF}$ acting across the suppressant by $$P_A^{DIFF}=C_W \rho_S W A_S$$

where $C_W$ is a non-dimensional inertia coefficient of the order of unity which depends upon the geometry of the container and w (m) is the width of slot-shaped suppressant outlet route. The width (upwind to downwind measurement) of the suppressant is Y (m) which is divided into two widths Q (m) and Z (m) by the interior baffle (namely Y=Q+Z). Z is the width of the section containing the suppressant outlet slot and Q is width of the section containing the air inlet. Then $C_W$ is dependent upon the ratios w/Z and Q/B where B was defined earlier. In fact $C_W$ will increase in value as either of the ratios w/Z or Q/Z increases.

The required formula relating ΔT to $N_2$ follow, namely $$\Delta T^*=\Delta T/\delta=2C_W[(\rho_S/\rho_A)/(C_A C_S)]^{1/2}[W/\delta V_A)]$$

and thus $$\Delta T^*=\sqrt{2}\ [W/D]C_W/[(C_A C_S)]^{1/2} N_2.$$

To provide an example of how the above formulae are used for design the size of a container is now estimated.

Thus the volume outflow rate of suppressant ($\theta_S$ m$^3$/s) from one container is approximately equal to $$\theta_S=w\ L\ U_S$$

where L (m) is the length of the container measured at right angles to the cross-section and w (m) is the width of slot-shaped suppressant outlet route. Note that the outlet route is chosen slot-shaped in order to simplify the calculation. A row of circular holes with larger diameter may be a more practical option if they reduce the likelihood of blockage.

To estimate the holding capacity of the container it will be assumed that the gas velocity immediately upwind of the apparatus increases in proportion to the time T (s) from the first arrival of over-pressure at the apparatus. The time taken for the explosion wind velocity to rise to its maximum $V^{AMAX}$ (m/s) is equal to the pressure-rise-time δ (sec). Thus $$V_A=V_A^{MAX}(T/\delta).$$

The total flow of suppressant ($\Theta_S$ m$^3$) through the outlet in this period is given by the integral with respect to time $$\Theta_S=\int_0^{\delta}\theta_S\,dT=wL[(\rho_A\ C_A)/(\rho_S\ C_S)]^{1/2}\int_0^{\delta}V_A\,dT.$$

Thus $$\Theta_S=[(\rho_A C_A)/(\rho_S C_S)]^{1/2}(\tfrac{1}{2}w\ L\ V_A^{MAX}\delta).$$

The above equation provides an approximate value for the holding capacity of the container and also shows how the capacity depends upon both the shape of the container and the characteristics of the explosion wind.

The sizes of the droplets in the atomised suppressant can be determined from the critical Weber number as discussed by Pilch and Erdman cited earlier. Droplet break up occurs when the Weber number is greater than 12. Thus if $\rho_A$ (kg/m$^3$) is the gas density and $U_{AO}$ (m/s) is the gas velocity at the point where the gas meets the suppressant outflow the droplet diameter $d_P$ (m) can be determined approximately in terms of the liquid surface tension $\sigma_S$ (N/m) from the equation $$d_P=12\ \sigma_S/(\rho_A U_{AO}^2)$$

The above equations are now used to determine dimensions for a specific container whose upwind shape is approximately semi-circular with a slot width w=0.001 m and inner depth D=0.015 m and $C_W\approx 5$. The gas velocity in the explosion wind at the apparatus is assumed to vary proportionally with time over the pressure-rise-time reaching a maximum $V_A^{MAX}=100$ m/s when the flame reaches the apparatus. Assuming an average flame speed of 50 m/s ($S_F=50$ m/s) and that the apparatus is a distance $R_F=20$ m from the ignition position then the pressure-rise time is approximately δ=340 milliseconds. To simplify the following analysis the compression effects on the gas due to the explosion over-pressure are neglected and therefore the density of the explosion wind is approximately equal to that of air at ambient conditions namely $\rho_A=1.3$ kg/m$^3$. If water is taken as the suppressant then the surface tension is approximately $\sigma_S=0.07$ N/m and its density is $\rho_S=1000$ kg/m$^3$.

Batchelor as cited above shows that $\alpha_O$ has a value of 2 for a circular cylinder. For a container with shape shown in FIG. 1 it will be assumed that $\alpha_O$ and $\alpha_I$ take the approximate values 2 and 1 respectively. Thus $$C_A=(2)^2-(1)^2=3.$$

The value for the suppressant discharge coefficient is assumed to be $C_S=1$. More accurate values for these coefficients can be determined through more detailed analysis of the gas and liquid flow using the detailed theoretical and/or experimental methods cited earlier.

First the influence of gravity is estimated by evaluating the dimensionless group $N_1$ assuming the acceleration due to gravity is approximately 10 m/s$^2$ thus $$N_1=(\rho_S\ g\ D)/\Delta P_A^{MAX}=2\ g\ D\ \rho_S/\rho_A/(V_A^{MAX})^2=0.0231<$$

This small value indicates that it should be possible to ignore gravitational effects.

Second the dimensionless group $N_2$ is evaluated as $$N_2 = (D/\delta)\Big/(\Delta P_A^{MAX}/\rho_S)^{1/2}$$
$$= (D/\delta)\Big/\left(1/2\,\rho_A\big/\rho_S(V_A^{MAX})^2\right)^{1/2}$$
$$= 0.0173 << 1$$

and furthermore $$\Delta T^* = \sqrt{2}[0.001/0.015]5/[3]^{1/2}0.0173 = 0.0047$$

This very small value of $\Delta T^*$ suggests that liquid will start flowing from the container well in advance of flame arrival at the apparatus. A more detailed analysis is necessary however to confirm that this important requirement is satisfied for the particular container and explosion dynamics of interest.

The water droplet diameter generated at the time the flame reaches the apparatus is $$d_P = 12\ \sigma_S/(\rho_A U_{AO}^2) = 0.6462/(\alpha_O V_A^{MAX})^2 = 16 \text{ micron.}$$

This value is in the size range identified earlier as capable of effective suppression in a gaseous flammable mixture of methane and air. The actual droplet size could be determined experimentally using for example laser diffraction sizing as described by Swithenbank, Beer, Taylor and Abbot in Progress in Aeronautics and Astronautics: Experimental diagnostics in gas phase combustion systems, 1977, 53:421.

The holding capacity of the container can be estimated from the equation $$\Theta_S = [(\rho_A\ C_A)/(\rho_S\ C_S)]^{1/2}(1/2\ wLV_A^{MAX}\delta)$$
$$= 0.03123(wLV_A^{MAX}\delta)$$
$$= 0.0011 \times L\ \text{m}^3.$$

With a depth of 1.5 cm a container with this holding capacity would be approximately 7 cm long.

Apparatus for suppressing deflagrative explosions according to the second aspect of the present invention comprises a plurality of the containers, preferably arranged in a stack or an array so as to maximise coverage of the area when the explosion wind arrives.

Figure 2:
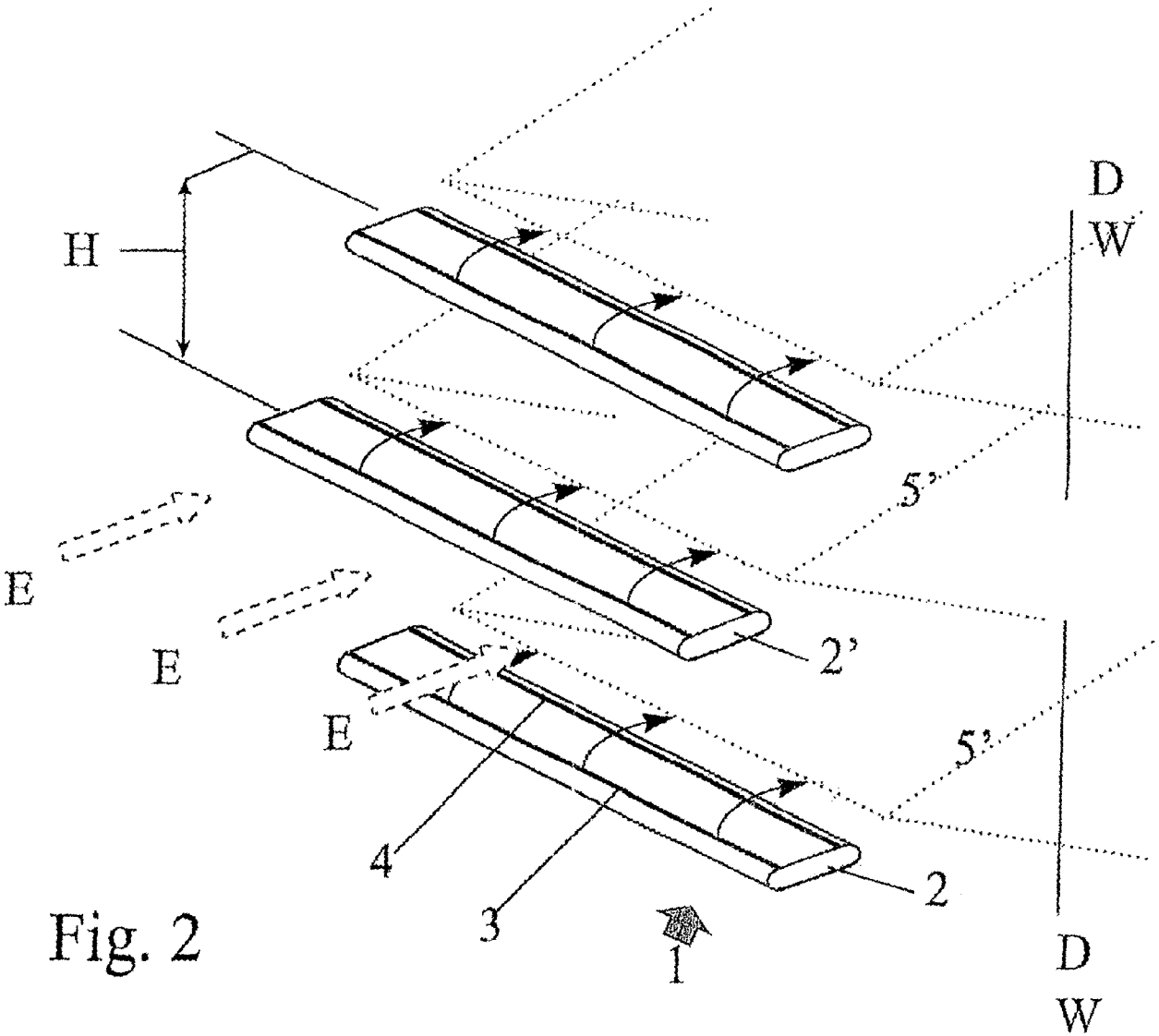
FIG. 2 shows an array of suppressant containers.

Referring to FIG. 2, it is necessary to ensure effective suppressant concentrations downwind of the apparatus in the region indicated as DW. Vertical separation distances H (m) between the containers are chosen so that the suppressant dispersed from a first container 2 overlaps and mixes with that dispersed by its immediate neighbour 2'. If $\theta_S$ ($m^3/s$) is the suppressant volume outflow rate from one container and $V_A$ is the mean velocity of the explosion wind E through the apparatus then the mean suppressant concentration ($\epsilon_S$) downwind of the apparatus can be estimated from the following equation by assuming the droplets are carried on the wind and disperse to form a uniform mixture $$\epsilon_S = \theta_S/(V_A\ L\ H) = w\ U_S/(V_A H).$$

Thus $$\epsilon_S = (w/H)[(\rho_A C_A)/(\rho_S C_S)]^{1/2}.$$

This equation indicates that the downstream suppressant concentration is dependent only upon the geometry of the container array and the densities of the explosion wind and suppressant. In practice the mixing pattern will be more complex and may need to be characterised in greater detail to determine how close to the apparatus effective concentrations are achieved.

For the specific container geometry and explosion conditions detailed above $$\epsilon_S = (w/H)[(\rho_A C_A)/(\rho_S C_S)]^{1/2} = 0.0624(w/H) = 6.24\times10^{-}$$

Thus a target volume fraction of $\epsilon_S = 2\times10^{-4}$ for water as the suppressant would require the containers to have a maximum separation distance of 0.312 meters.

Figure 3:
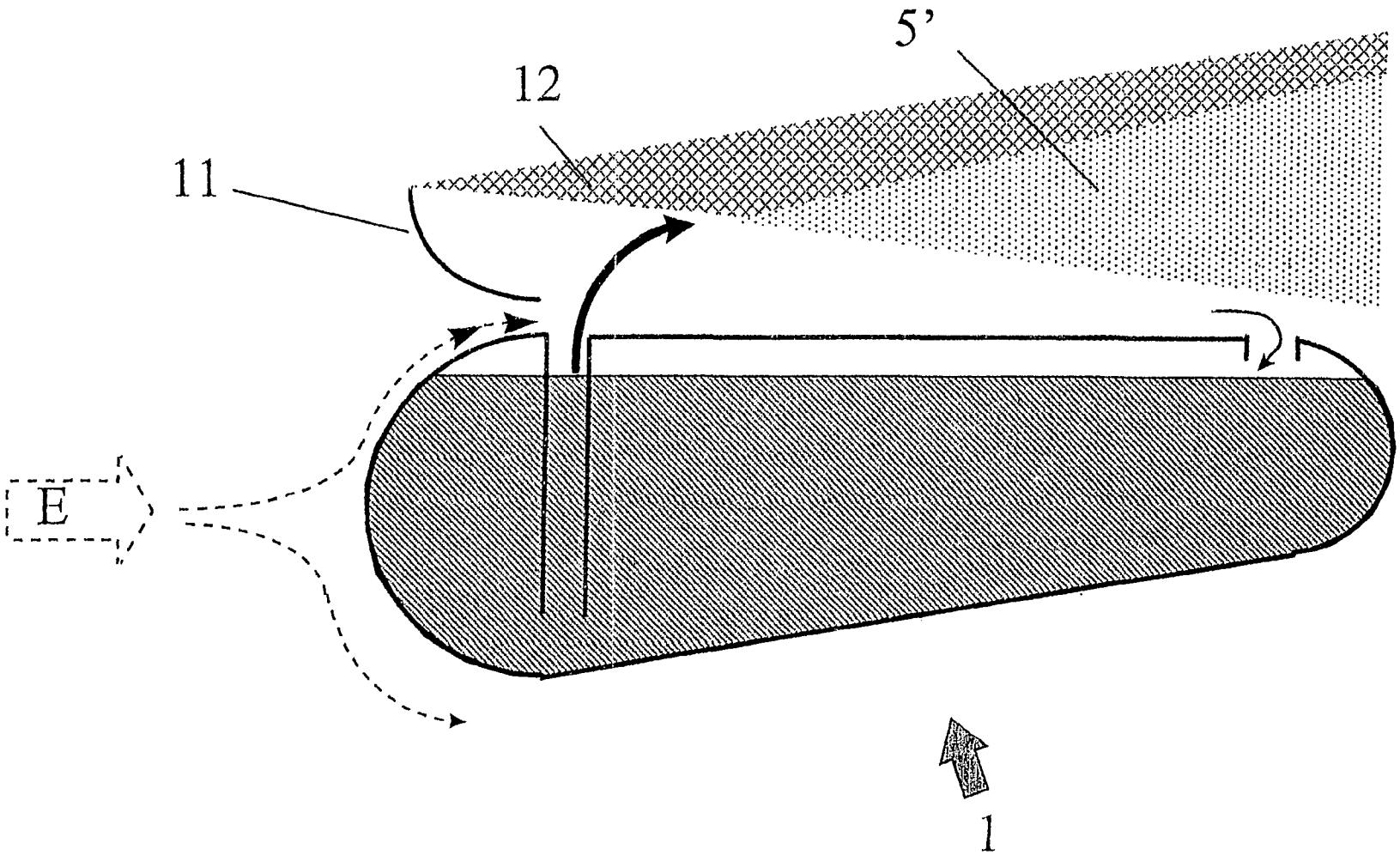
FIG. 3 shows a container with a spoiler attached at the upstream side adjacent to the suppressant outlet.

As shown in FIG. 3, a spoiler 11 or other such attachment can be attached to the upstream edge of the container 1 and can act to both increase the velocity of gas passing the suppressant outlet 3 and also create a wake flow 12 which can enhance mixing and dispersal of the suppressant 5'. Such a feature could extend the application of the apparatus by providing effective suppression at lower explosion wind velocities and/or closer to the apparatus.

Figure 4:
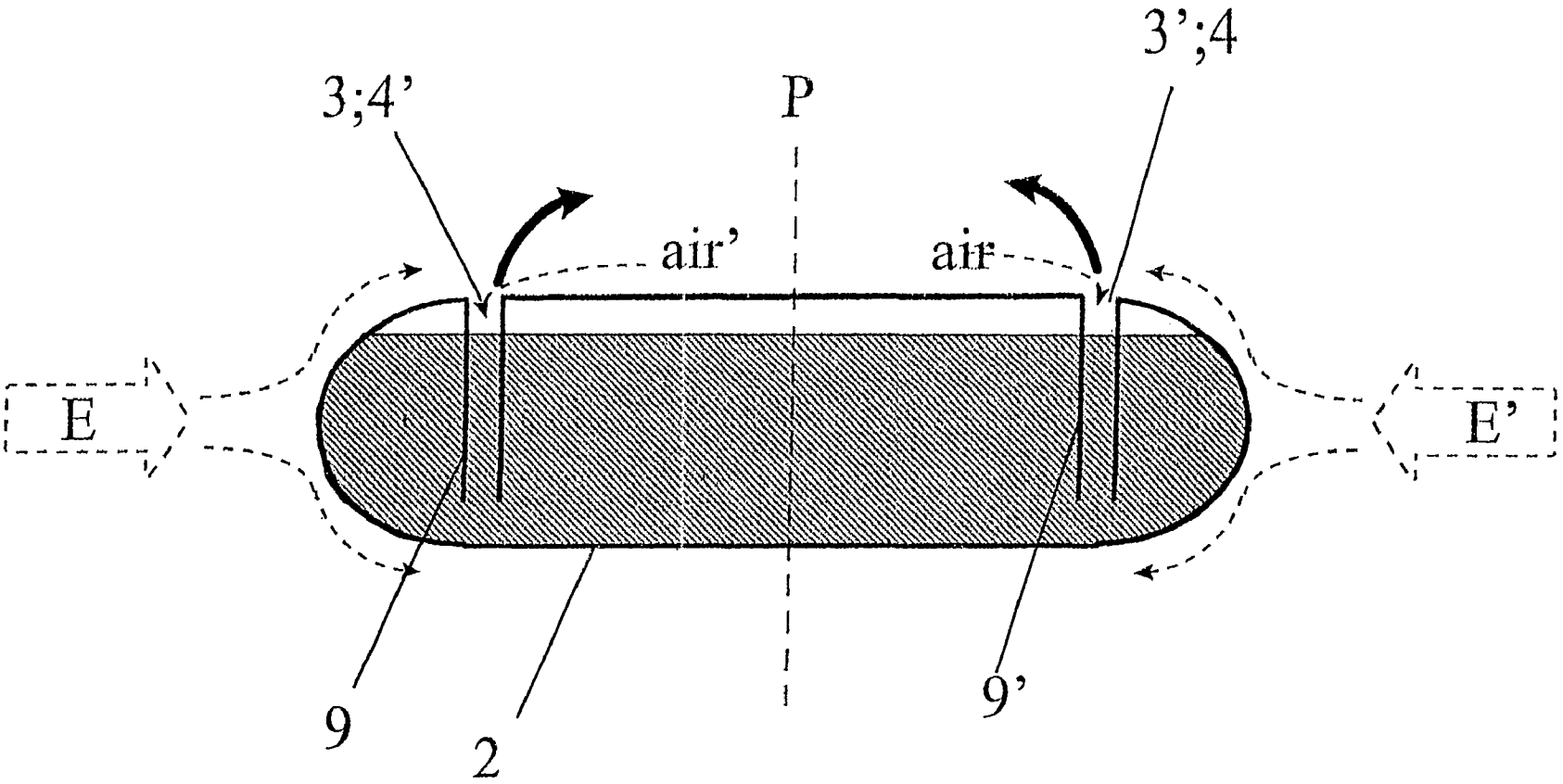
FIG. 4 shows a container with a symmetrical lateral cross-section.

In an alternative embodiment illustrated in FIG. 4, the container has a cross-sectional shape which is symmetrical about a plane P intermediate the outlet and inlet. In fact, in this symmetrical container, the two apertures act as both an air inlet (4; 4') and a suppressant outlet (3; 3'). Both apertures have flow guides 9; 9' associated therewith. The symmetrical nature of the container means that the suppressant will respond in a similar way irrespective of the direction of the approaching explosion wind E;E', namely whether it flows from right to left in FIG. 4 (E') or from left to right (E). If suppression was required on both sides of the apparatus then such a feature would reduce the number of containers required thus potentially reducing construction costs, the size and the aerodynamic resistance of the apparatus.

Figure 5:
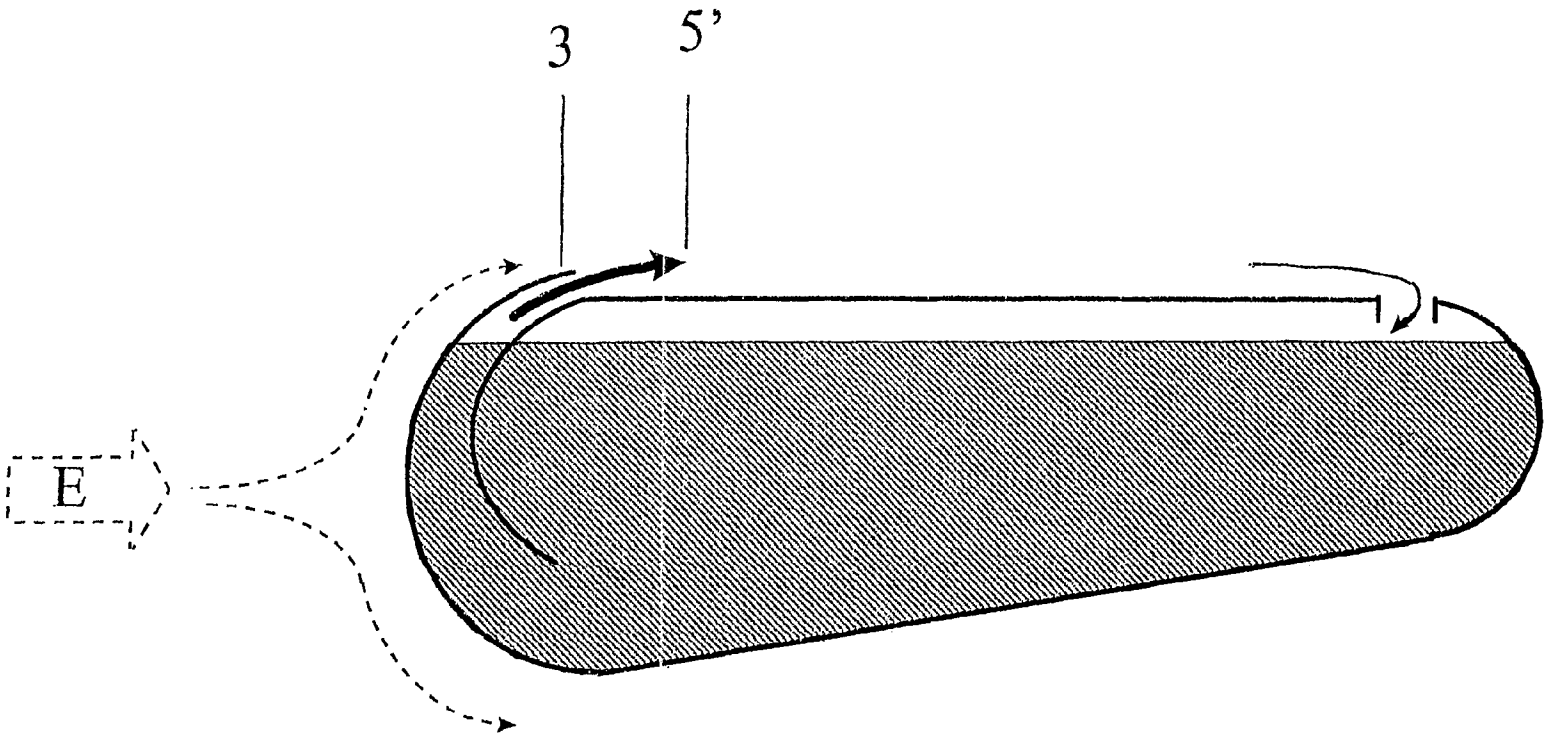
FIG. 5 shows a container with a narrowing outlet route directing a thin sheet of suppressant close to the upper surface of the container.

FIG. 5 shows a further embodiment of the container in which the flow guide 9 is curved and is nearer the leading edge of the container (at the far left of FIG. 5). By varying the external shape of the container and/or the shape of the flow guide, the thickness and/or direction and/or velocity of the film of suppressant 5' exiting the outlet 3 can be controlled. This feature improves the effectiveness of dispersal and, if the suppressant is liquid-based, the atomisation of the suppressant to be controlled. Directing the suppressant film away from surface of the container will affect mixing in the near vicinity of the container. Directing the liquid along the top surface of the container will affect atomisation of a liquid suppressant.

Figure 6:
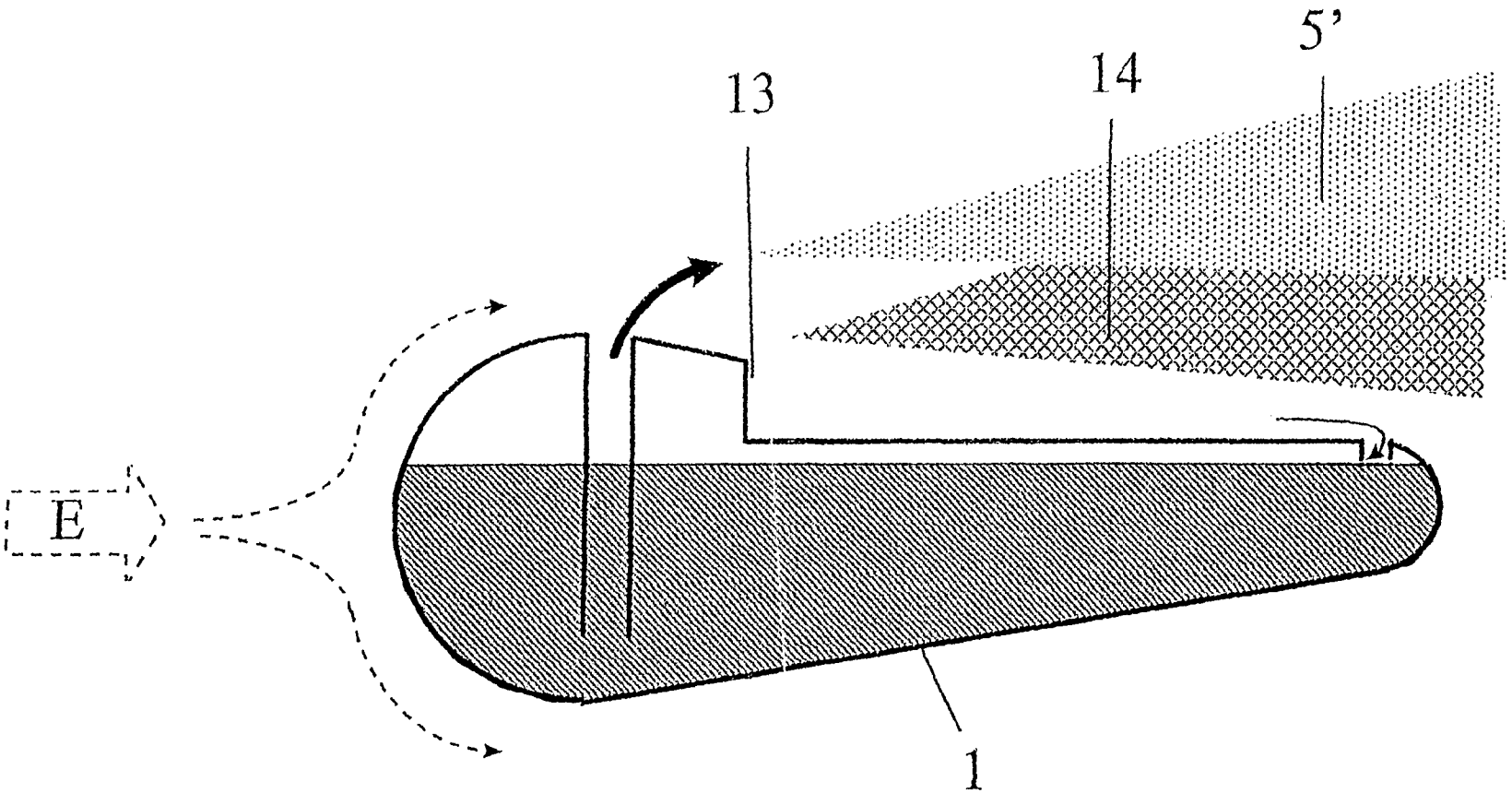
FIG. 6 shows a container whose outer shape has a step therein to generate a shear layer in the gas flow.

Referring to FIG. 6, a further embodiment of the container is shown which has a step 13 in its external surface. Other shaped discontinuities in the external surface may have the same effect which is to create a turbulent shear layer 14 which enhances the dispersal of atomised suppressant 5' near to the container 1. This feature could be used in applications where the flame needed to be suppressed very close to the apparatus.

Figure 7B:
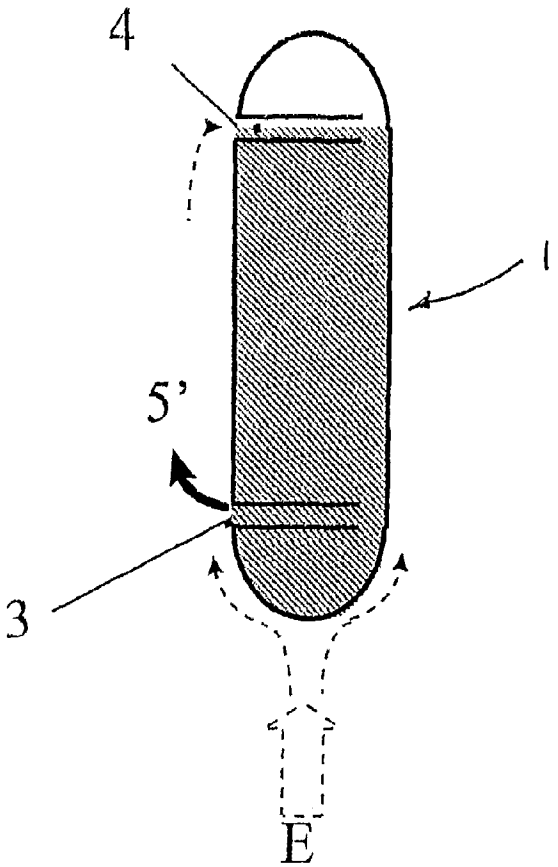
FIG. 7B shows the container of FIG. 7A in use.
Figure 7A:
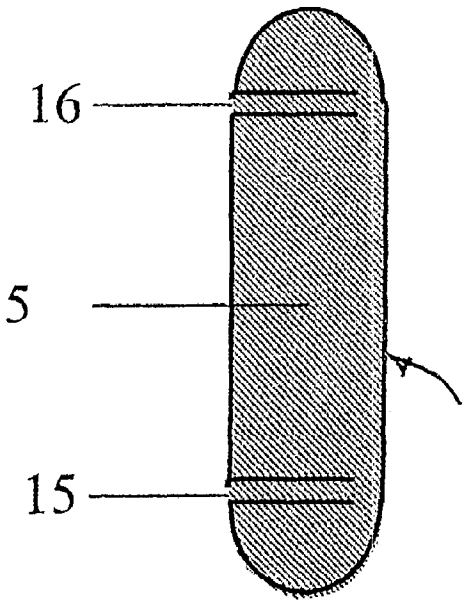
FIG. 7A shows a container whose contents are prevented from leaking by friable membranes over the suppressant outlet and air inlet.

FIGS. 7A and 7B show a further embodiment of the container in which there are friable membranes 15, 16 over the outlet 3 and air inlet 4 respectively. This enables the container 1 to be mounted in an orientation other than with the outlet and inlet uppermost because the membranes 15,16 prevent the suppressant 5 from leaking from the container. When an explosion wind arrives, the gas dynamic forces exerted by the explosion wind E cause the membranes to rupture (as shown in FIG. 7B) to allow suppressant to leave the outlet 3 and air to enter the inlet 4. This feature enables the containers to be mounted in any orientation and thus suppression can be achieved irrespective of the direction of flame propagation.

Figure 8:
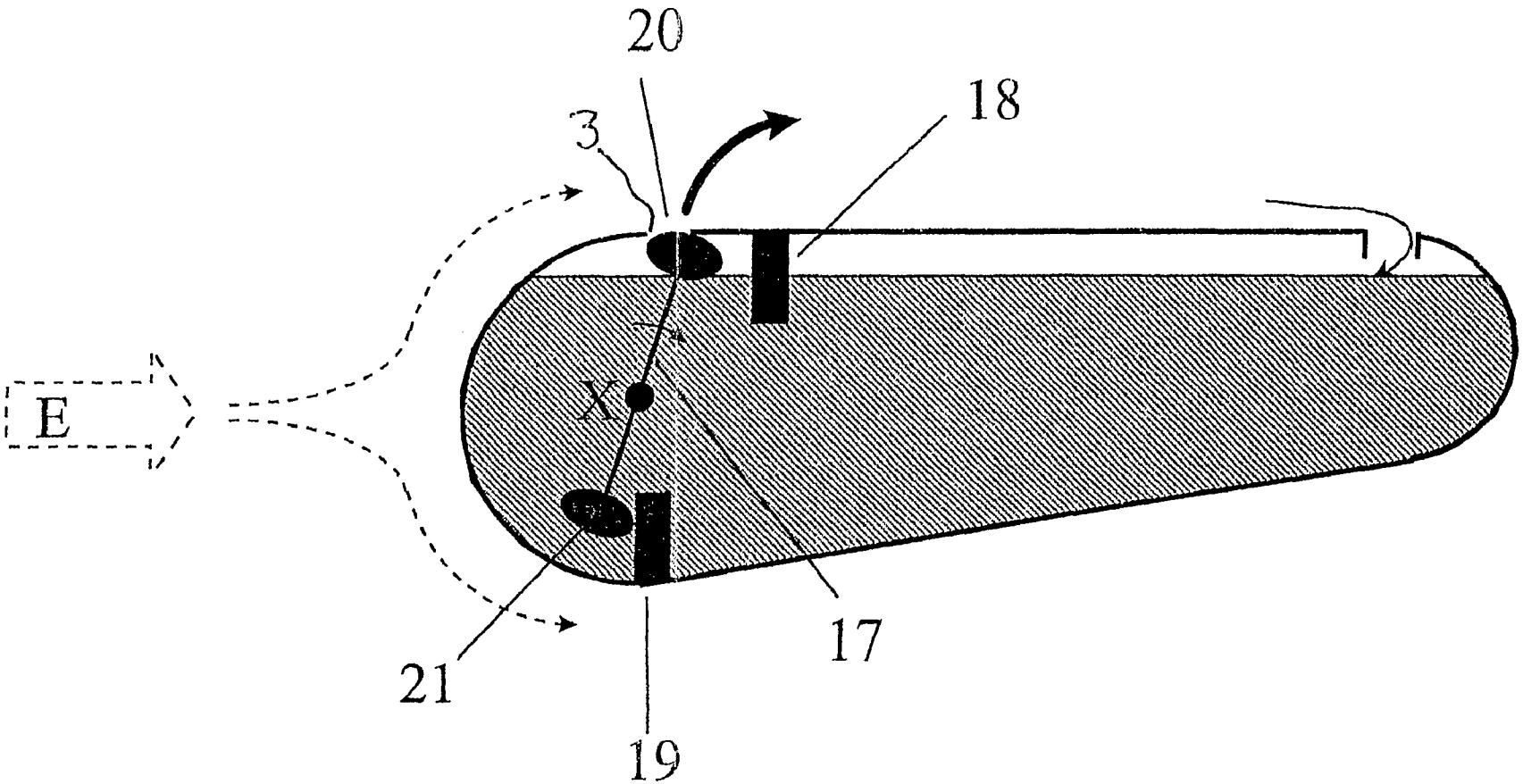
FIG. 8 shows a container having, a pivotable plate inside whose position changes as suppressant flows out of the container.

A further embodiment of the container is shown in FIG. 8 in which the flow guide comprises a pivotable plate 17 and baffle plates 18 and 19. The plate 17 is pivotable about a point X and has expanded end regions 20, 21. Initially, before an explosion wind arrives, the expanded end region partially blocks the suppressant outlet 3. The plate 17 is prevented from completely blocking the outlet 3 because the other expanded end region 21 abuts a baffle plate 19 in the deepest part of the container. When the explosion wind arrives and suppressant starts to flow from the outlet 3, hydrodynamic forces cause the plate 17 to pivot as indicated by the arrow in FIG. 8, moving the expanded end region 20 away from the outlet 3 so as to widen the outflow exit route. The expanded end region 20 abuts a second baffle plate 18 so as to form a flow guide for the suppressant and to prevent air passing directly between the inlet and outlet. The baffle plate 18 necessarily runs the whole length of the container. The inertia of the pivotable plate 17 will delay the time taken for the opening in the outlet 3 to reach a maximum. This feature would allow the container holding capacity to be reduced by delaying suppressant outflow.

Figure 9:
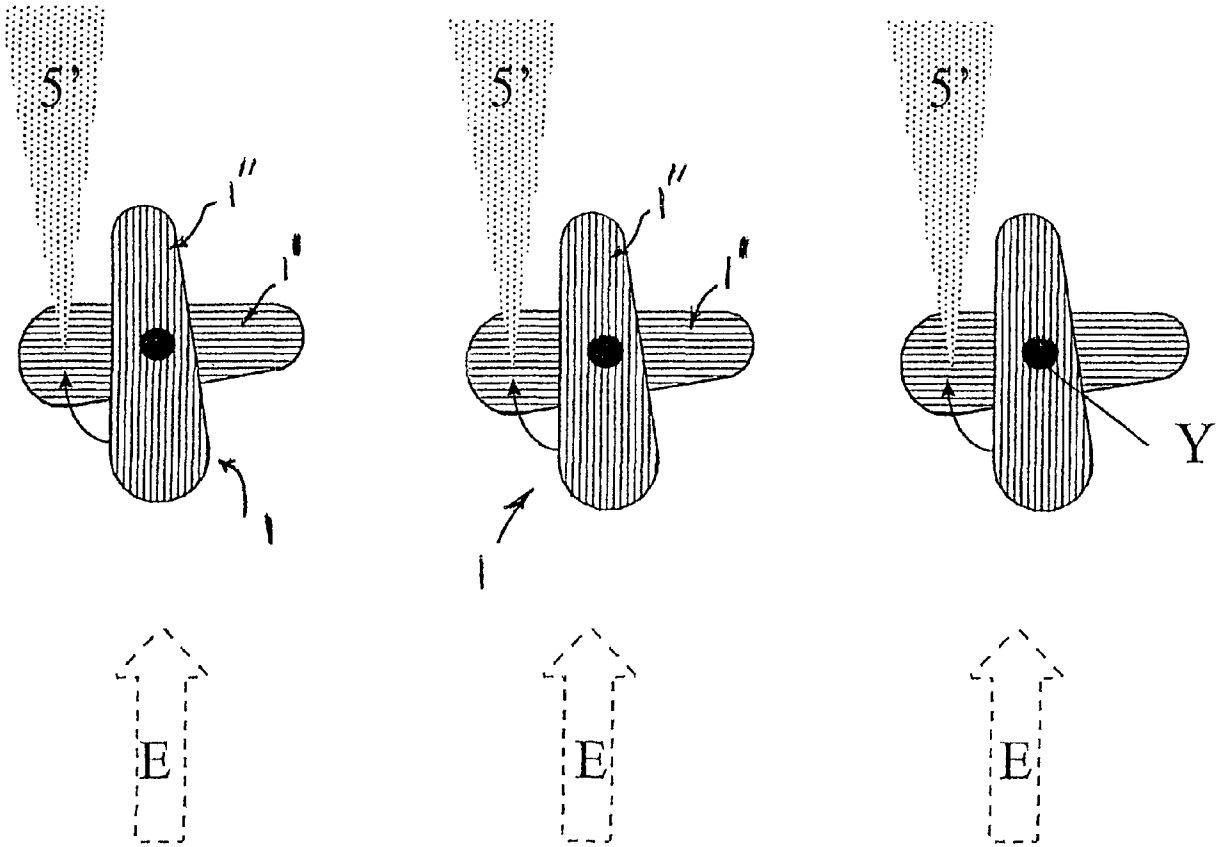
FIG. 9 shows an array of containers which can rotate when exposed to an explosion wind.

Clearly, it is necessary for the containers to present their "leading edge" (i.e. the edge nearest the suppressant out-let) to the approaching explosion wind. If it is difficult to predict the likely explosion wind direction, many containers may need to be set up in different orientations. However, the number of containers required can be reduced by using containers of the type illustrated in FIG. 9, wherein the containers 1 are mounted so that they can pivot about a point Y. They are mounted in their normal orientation (shown as 1' in FIG. 9) but can rotate, say through 90 degrees, under the gas dynamic forces exerted by the explosion wind E to a position 1" in which the suppressant 5' leaves the container in the upstream direction. The time taken for the containers to rotate to the position when they start to release suppressant must be substantially less than the time taken for the flame to reach the apparatus. This feature favours the normal orientation of the containers being different from that during the explosion. Thus a normal horizontal orientation could be chosen to prevent suppressant loss or leakage in apparatus for suppressing a vertically propagating flame. A normal vertical orientation could be chosen so that the container array provides protection from natural winds in apparatus for suppressing a horizontally propagating flame. This latter option would require some additional means of preventing suppressant leakage from the containers (for example the friable membranes described above).

Figure 10B:
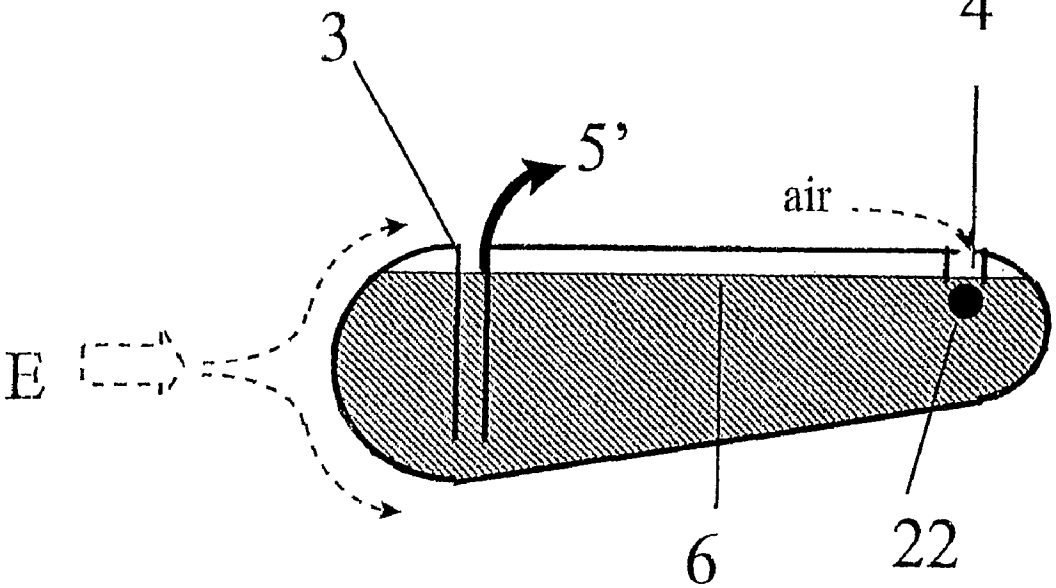
FIG. 10B shows the container of FIG. 10A, in use.
Figure 10A:
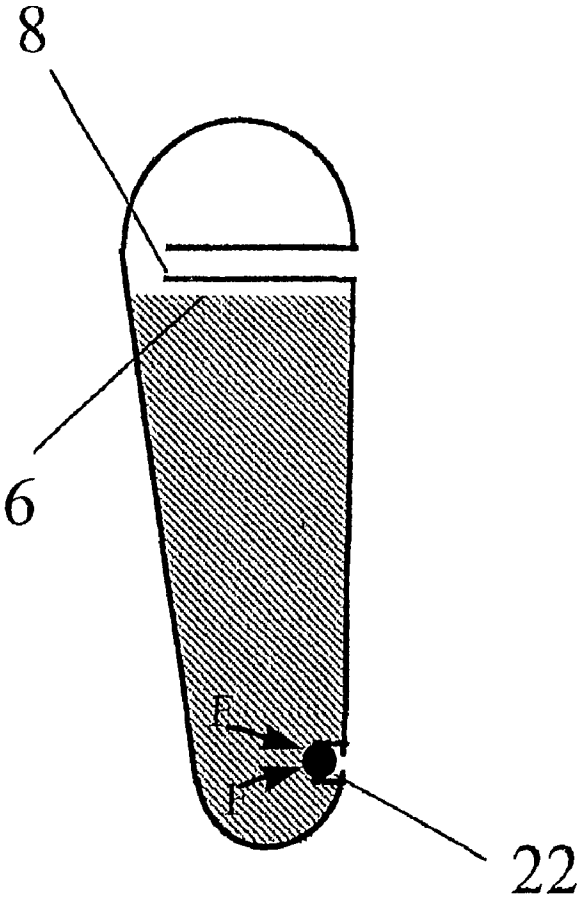
FIG. 10A shows a container having a valve in the air inlet.

In a further embodiment of the rotatable container described above, as illustrated in FIGS. 10A and 10B, a ball valve 22 is held in the air inlet 4 by the hydrostatic pressure force F exerted by the suppressant when the container is oriented vertically (FIG. 10A). In the vertical orientation the suppressant does not leak because the normal suppressant level 6 is below the intake 8 to the flow guide. As shown in FIG. 10B, when an explosion wind E arrives, the gas dynamic loading rotates the container and the normal suppressant level 6 readjusts. The pressure difference across the ball 22 causes it to move into the container away from inlet 4 which allows air ingress and thereby suppressant outflow at the outlet 3. This feature would allow the containers to be oriented vertically under normal conditions without the need to continuously replenish leaking suppressant.

The ball valve arrangement and pivotable plate are examples of the "flexible or moving parts" referred to in the claims.

Figure 11:
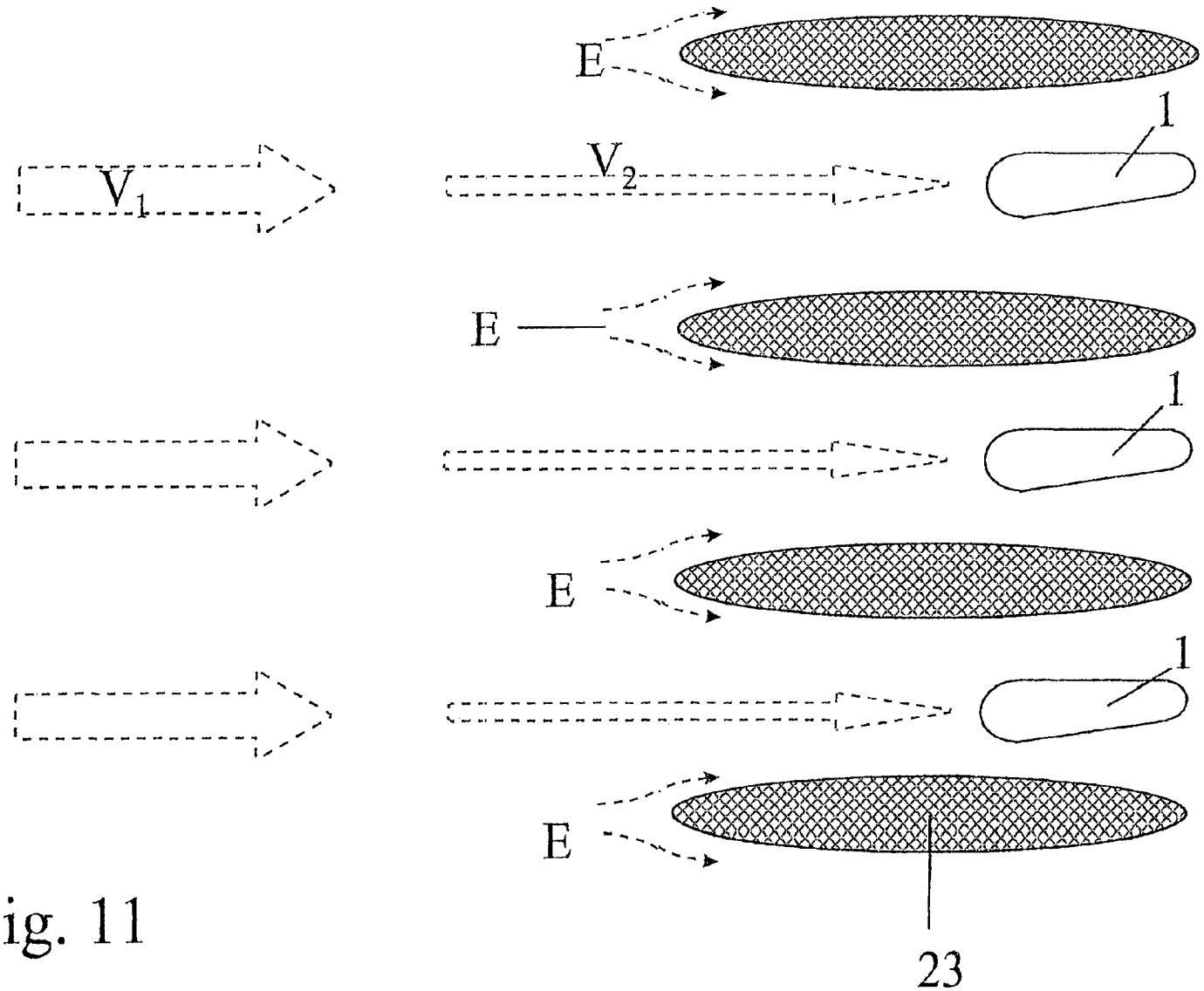
FIG. 11 shows an array of containers including aerodynamically smooth guide means which enhance suppressant dispersal.

Referring to FIG. 11, aerodynamically smooth guide means 23 may be included in the explosion suppression apparatus together with the array of containers 1. The guide means 23 converge the explosion wind E so that its approach velocity to the containers $V_2$ is higher than its normal approach velocity $V_1$. The higher velocities thereby shorten the time taken for the suppressant to be dispersed and/or reduce the size of liquid suppressant droplets. Such a feature would enable an apparatus to be effective at lower explosion wind velocities such as generated within the confined region by a confined explosion.

Figure 12:
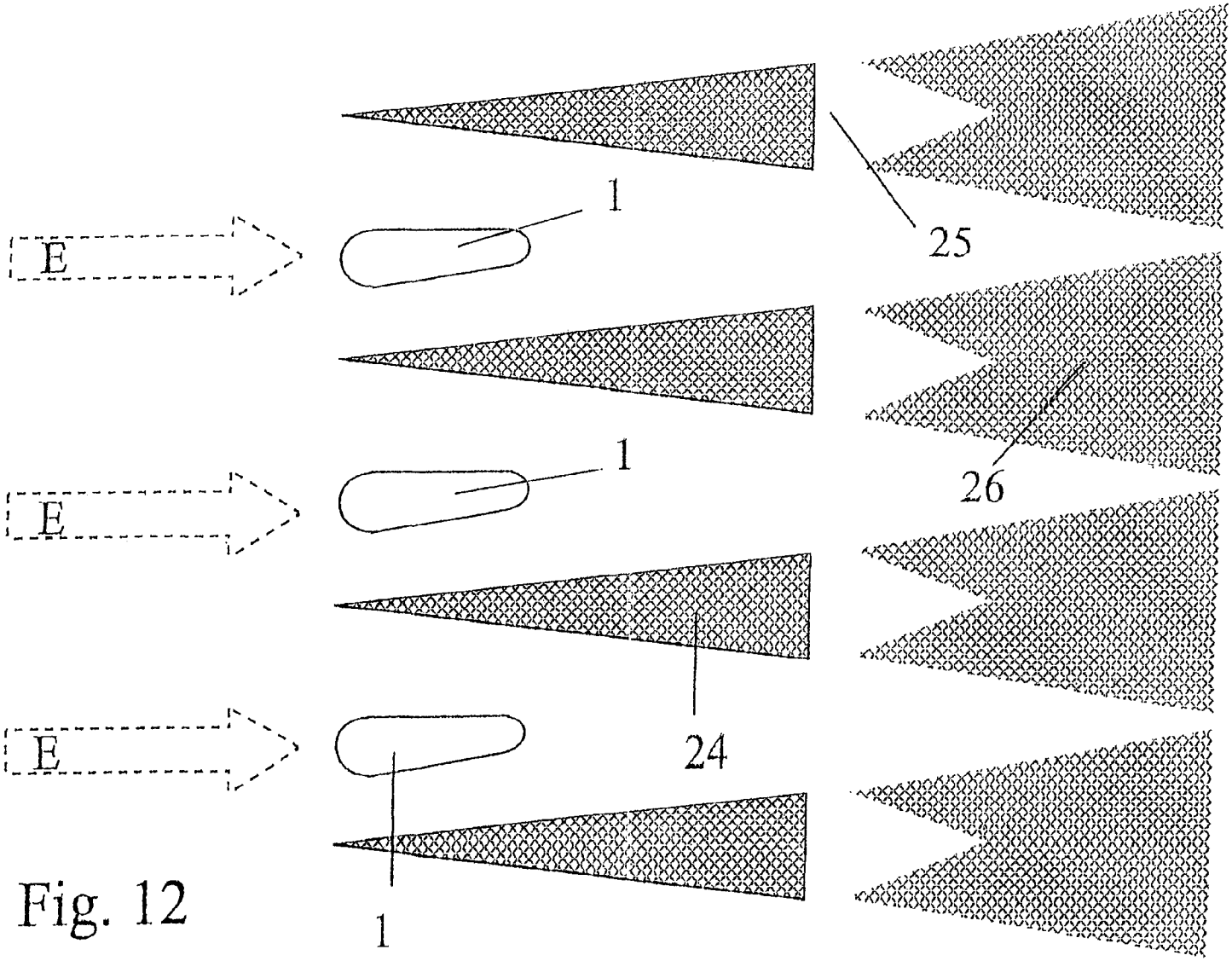
FIG. 12 shows a container array containing turbulence-generating means to enhance downstream mixing.

Referring to FIG. 12, the apparatus can include turbulence-generating means 24 in the container array which have a bluff downwind profile 25 to create downwind turbulence 26. The turbulence enhances the mixing of the suppressant downstream of the apparatus. Such a feature could be used to move the position at which suppression occurs closer to the apparatus.

Figure 13B:
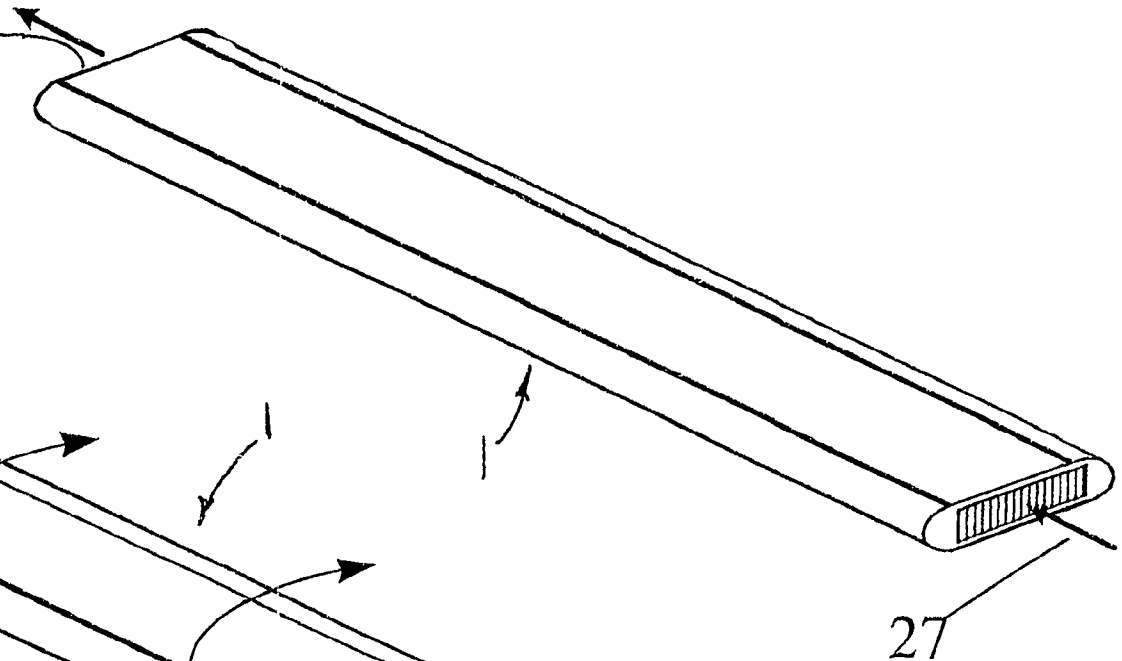
FIG. 13B shows a container having an additional inlet and outlet.
Figure 13A:
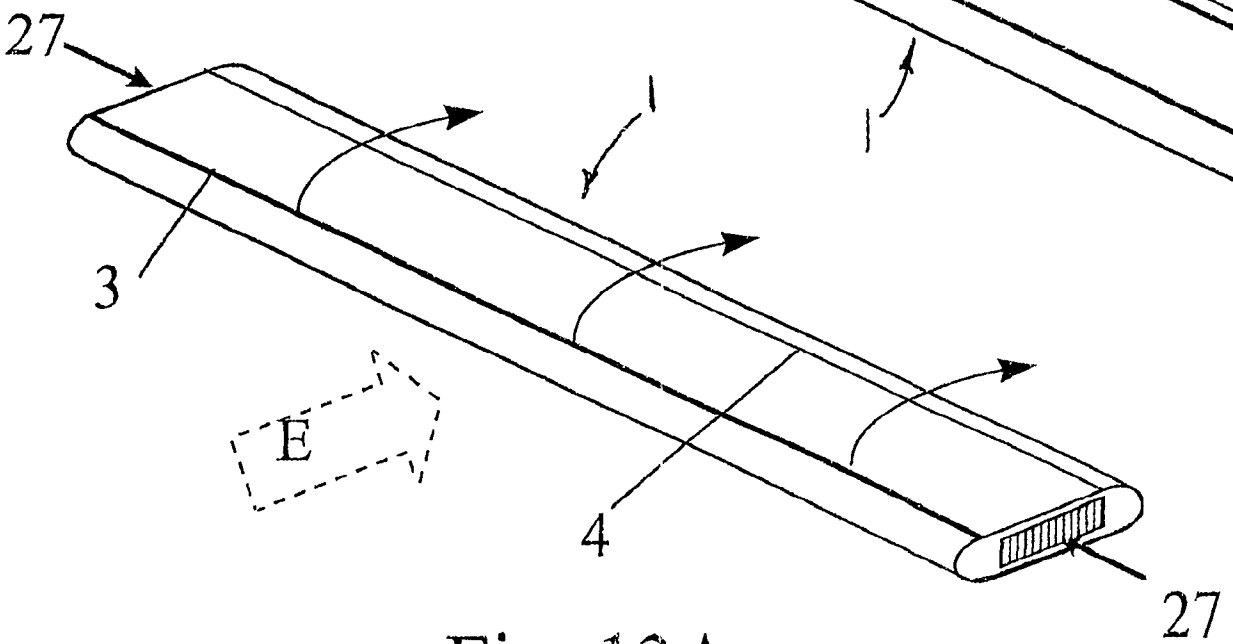
FIG. 13A shows a container having two additional inlets.

Referring to FIG. 13B, an additional suppressant inlet 27 and outlet 28 provide a flow route from one end of the container 1 to the other. Through these, the level of suppressant within the container can be maintained or replenished (as suppressant may evaporate, for example, if left standing for a long period of time). Alternatively, as shown in FIG. 13A, two additional inlets 27 can be provided to maintain the suppressant level actually during an explosion. These features would enable the suppressant to be maintained under natural loss or leakage due to evaporation or natural wind passage through the apparatus. The features would also allow hydraulic or gas pressure to be used to replenish suppressant during the course of the explosion. This could enable the appliance to cater for explosions with longer pressure-rise-times.

Figure 14:
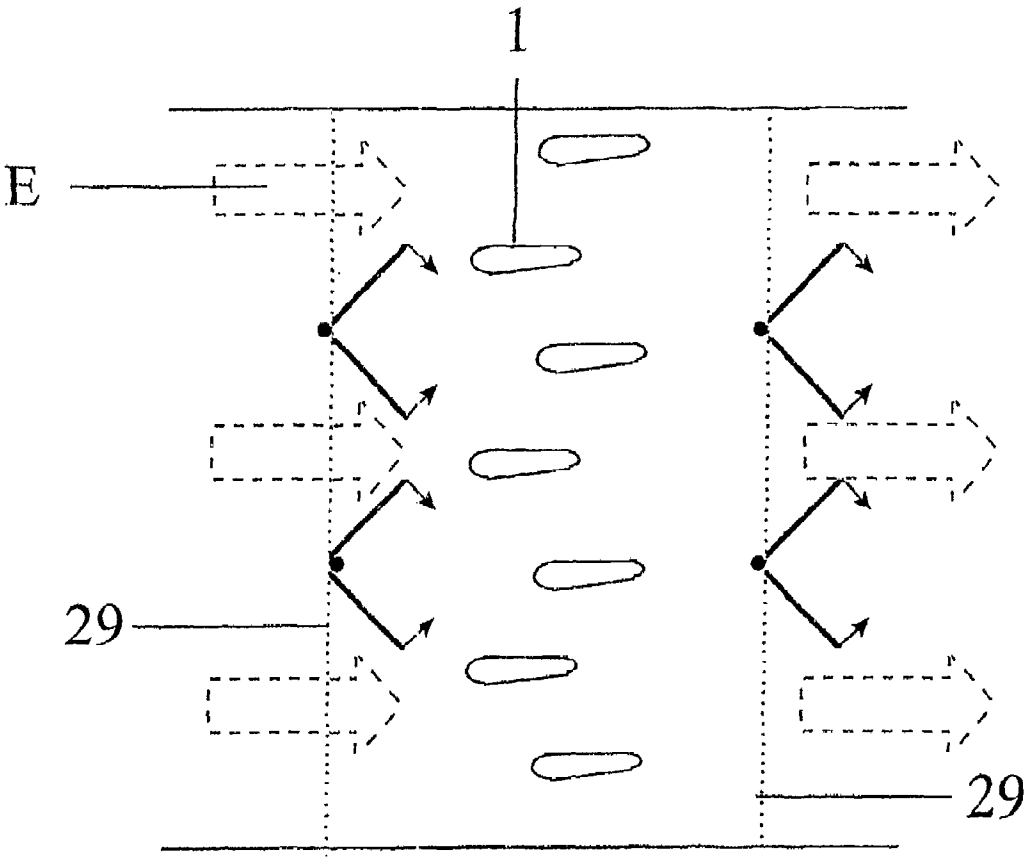
FIG. 14 shows an apparatus mounted inside a friable wall through which the explosion wind can pass.

Referring to FIG. 14, the apparatus may be housed within a friable wall 29. In this way the containers can be normally hidden from view. During the course of an explosion, the wall 29 allows the explosion wind E to enter the apparatus and pass by the containers 1. The friable panels must be such that they admit the explosion wind through the apparatus in a time substantially before the flame reaches the apparatus. This feature has the advantage that the apparatus can be hidden in a wall or roof under normal conditions and provide both a pressure relief vent and flame suppression. The apparatus is also protected from dirt and natural winds under normal conditions.

Figure 15:
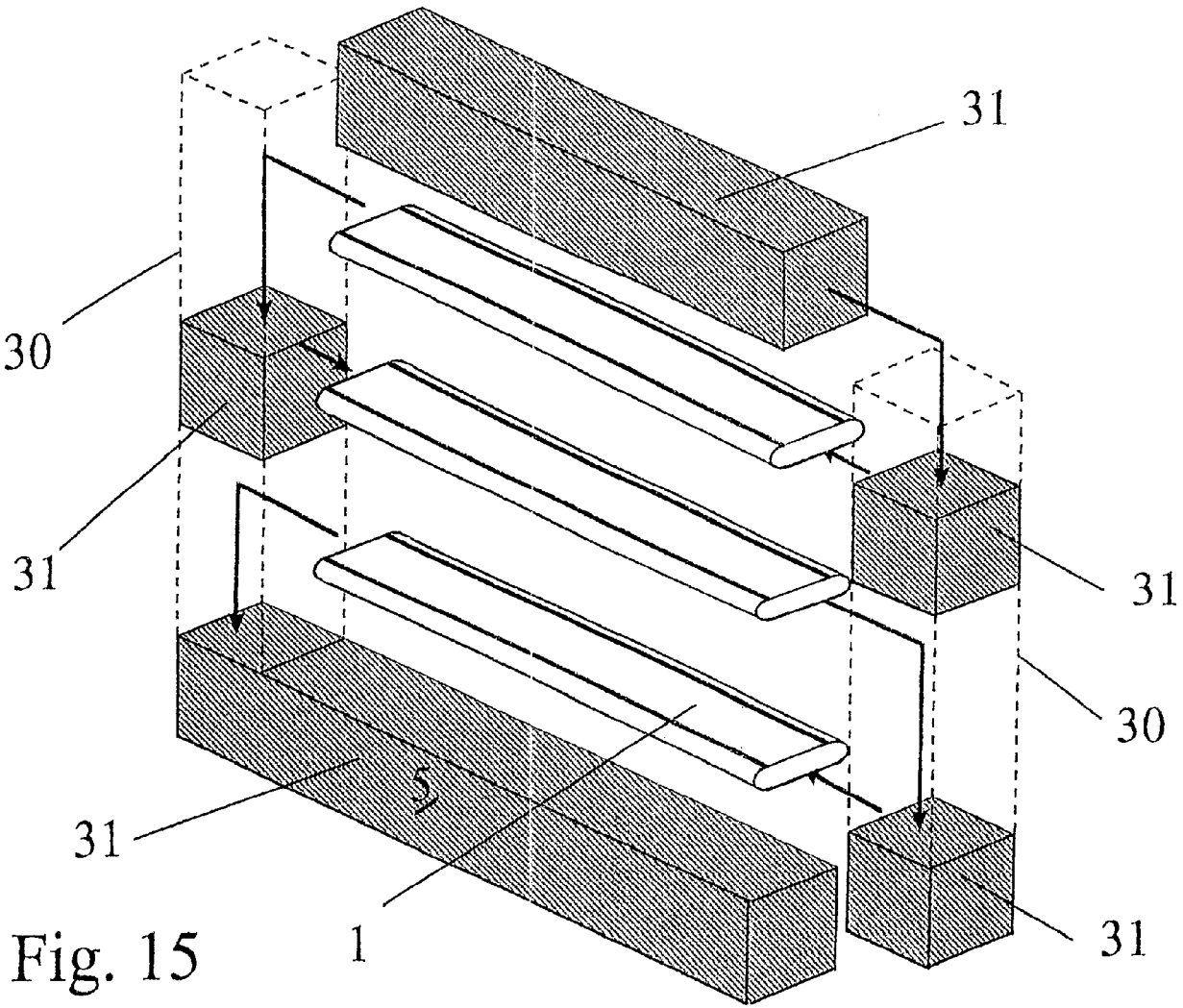
FIG. 15 shows an array of containers mounted in a frame with reservoirs where suppressant can collect.

The containers 1 are stacked in an array as illustrated in FIG. 15 and mounted in a frame 30 which has reservoirs 31 in which liquid suppressant 5 can collect. The additional mass provided by the suppressant reservoirs 31 helps the apparatus to resist motion during the explosion. This feature enables lighter weight construction materials to be used for both the containers 1 and frame 30.

Figure 16:
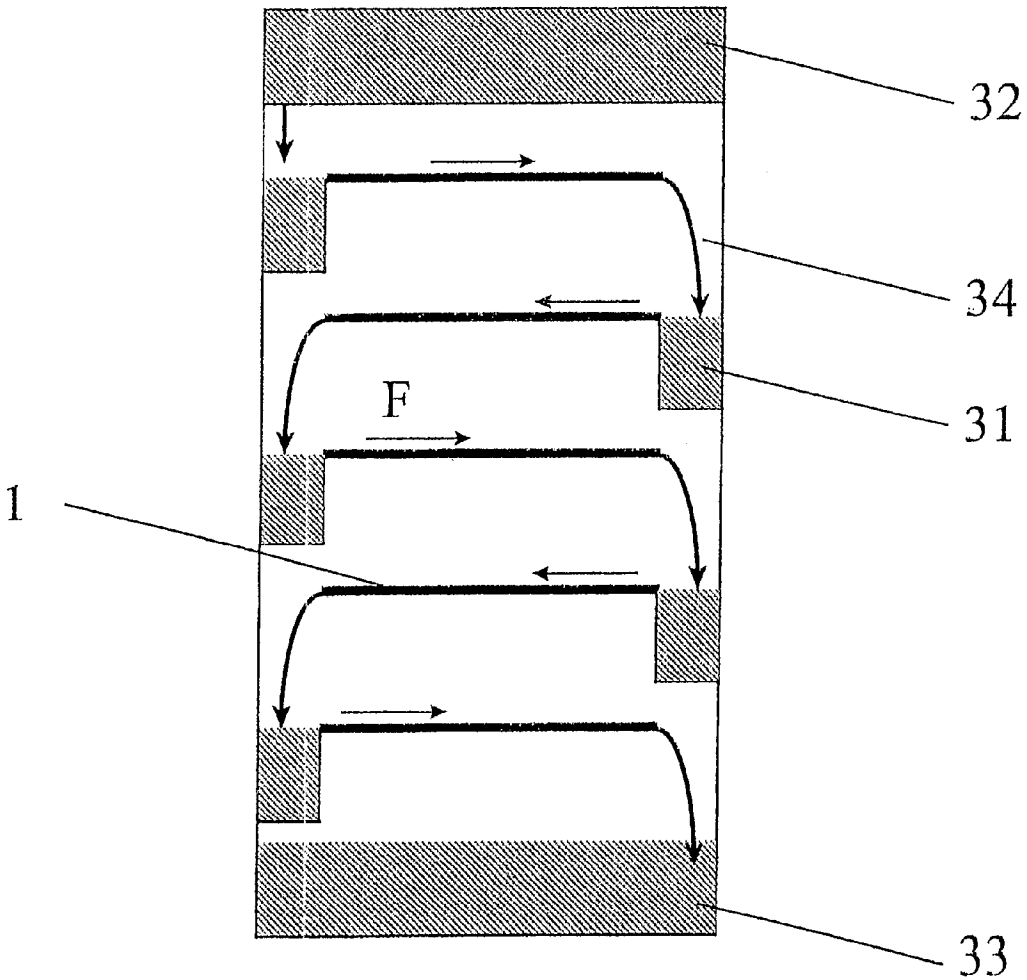
FIG. 16 shows a gravity driven cascade flow system

Referring to FIG. 16, the apparatus can include a gravity-driven cascade flow system for supplying the liquid suppressant to the containers 1. Suppressant flows from a head tank 32 to a sump tank 33 through a series of cascades 34 and a series of reservoirs 31 provide a gravity driven flow F through the containers 1. Such a flow system can replenish the suppressant under normal operation. By not needing piping or other narrow bore flow routes this feature lessens the likelihood of blockage.

Figure 17:
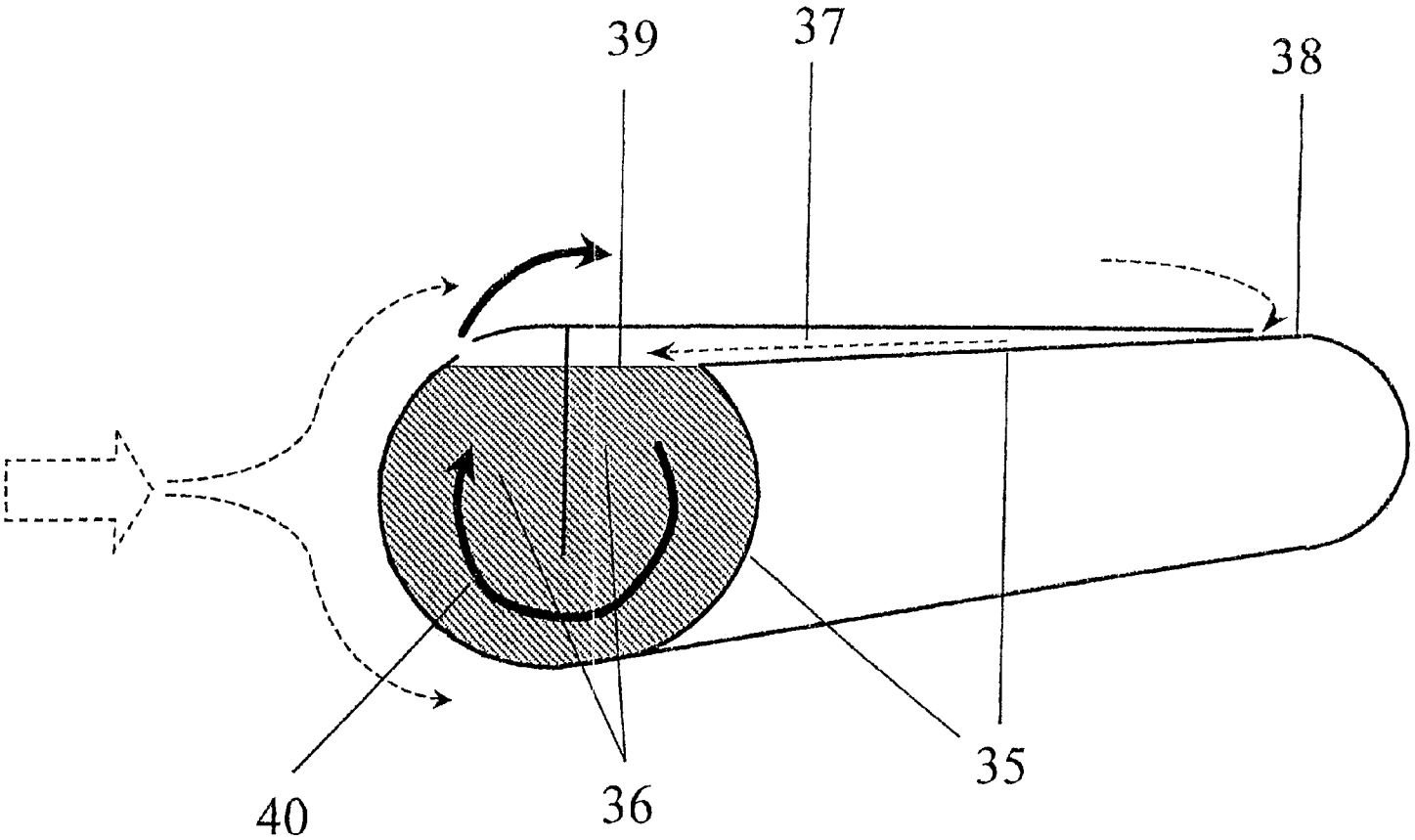
FIG. 17 is similar to FIG. 1 of another embodiment of explosion suppressant container within the ambit of the present invention.

FIG. 17 shows an embodiment in which an inner boundary 35 confines the suppressant to the upwind portion of the container 36 and also provides an air flow route 37 from the air inlet 38 to the upper surface of the suppressant 39. This feature enables the external gas flow to exert the same pressure difference as that shown in FIG. 1 but the flow route 40 of the suppressant to the outlet is shorter. This feature enables the device to respond more quickly to changes in the explosion wind.

Figure 18:
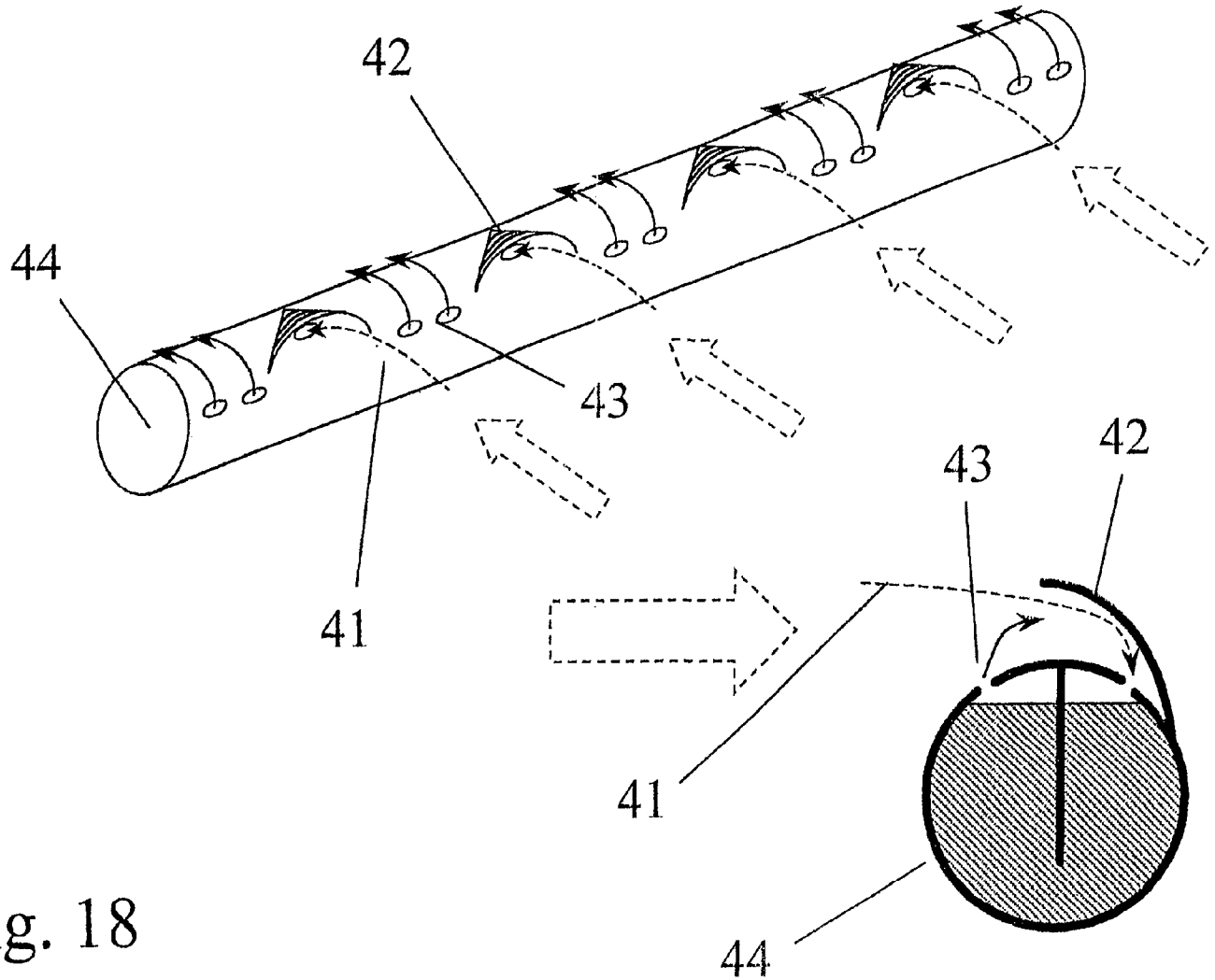
FIG. 18 is a perspective view of another embodiment of container.

FIG. 18 shows an embodiment in which the air inlet routes 41 have cowlings 42 whose intakes are directed upwind. The suppressant outlets 43 are distributed between the cowlings so as to prevent out-flowing suppressant entering the air intakes. This feature has the advantage that the stagnation pressure of the air stream is utilised to force the suppressant out of the container and therefore the aerodynamics at the downwind end of the container are less important in determining the effectiveness of the device. Thus the figure shows the container to have a circular cross-section 44.

Figure 19:
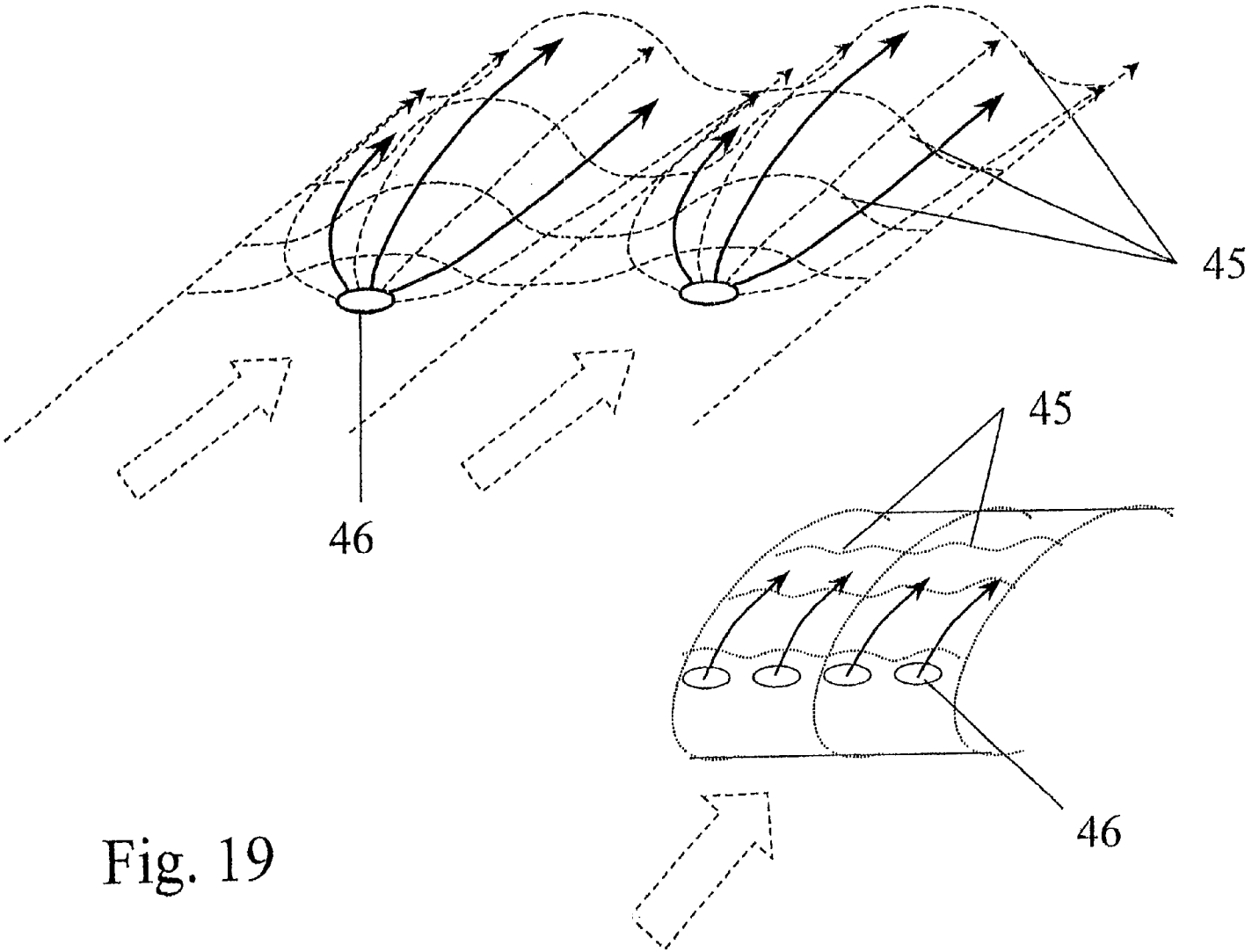
FIG. 19 shows possible surface profiles of a container.

FIG. 19 shows an embodiment in which the upper surface of the-container 45 downwind of the suppressant outlet holes 46 is profiled. The profiling is shown here as undulating, the amplitude of the undulations increasing with downwind distance from the suppressant outlet holes. This feature causes the suppressant to form a film that spreads downwind over the profiled surface. The surface area of the liquid in contact with the air stream will thus be larger than that of a container-with a flat upper surface. This feature will enhance the effectiveness of the device by increasing the suppressant atomisation rate and ensuring that the droplets are dispersed more rapidly into the passing air stream.

Figure 20:
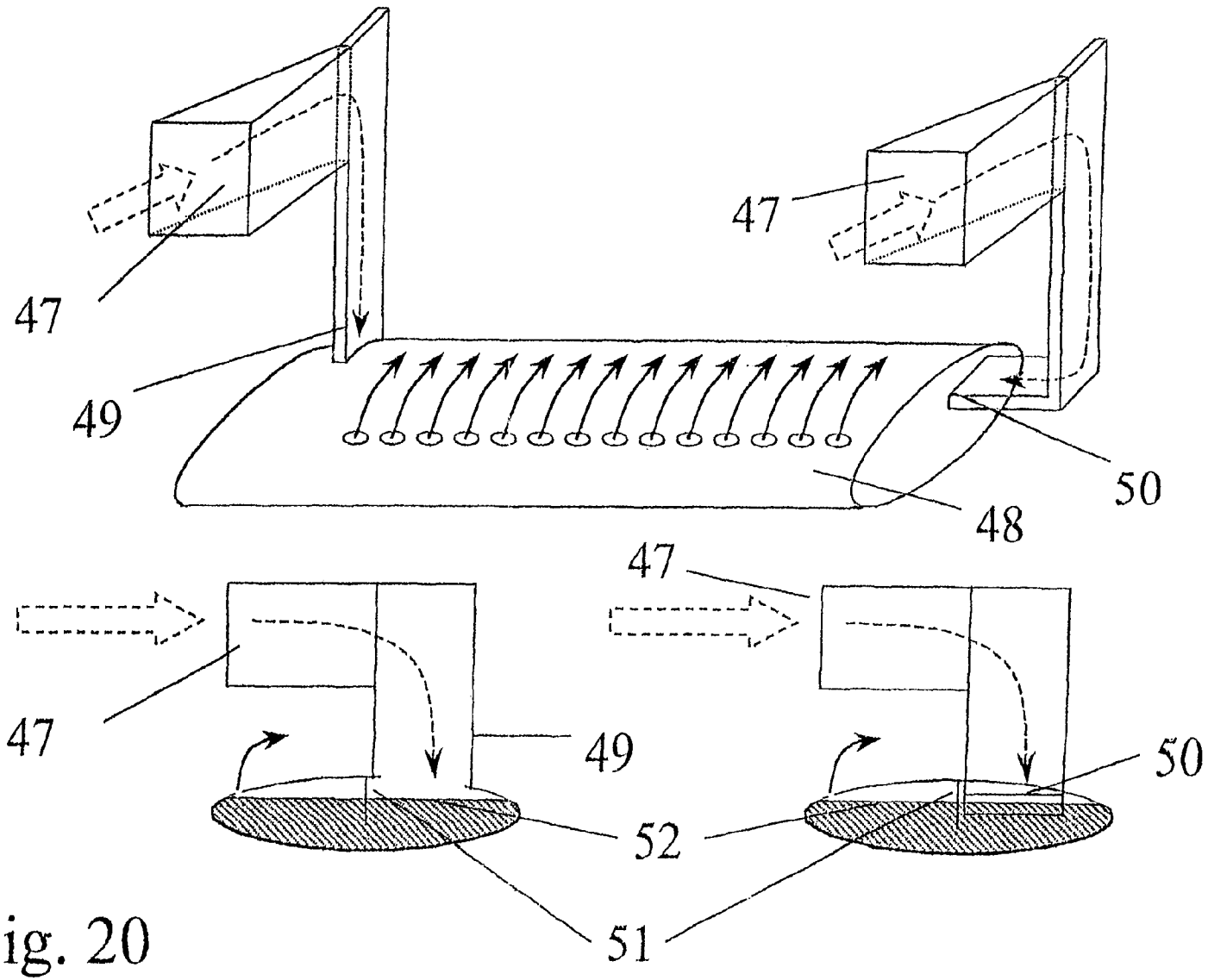
FIG. 20 shows a different arrangement of air intakes.

FIG. 20 shows an embodiment of the container in which the air intake routes 47 are remote from the container 48. In the arrangement shown, the air is ducted from inlets into the downwind topside 49 and/or side 50 of the container. Here an unobstructed air route is required from the air intakes to the upper surface of the suppressant on the downwind side of the interior baffle 51. The level of the suppressant 52 provides sufficient space between it and the roof of the container for the required air route. Air is prevented from flowing directly to the suppressant outlet by the interior baffle 51.

Figure 21:
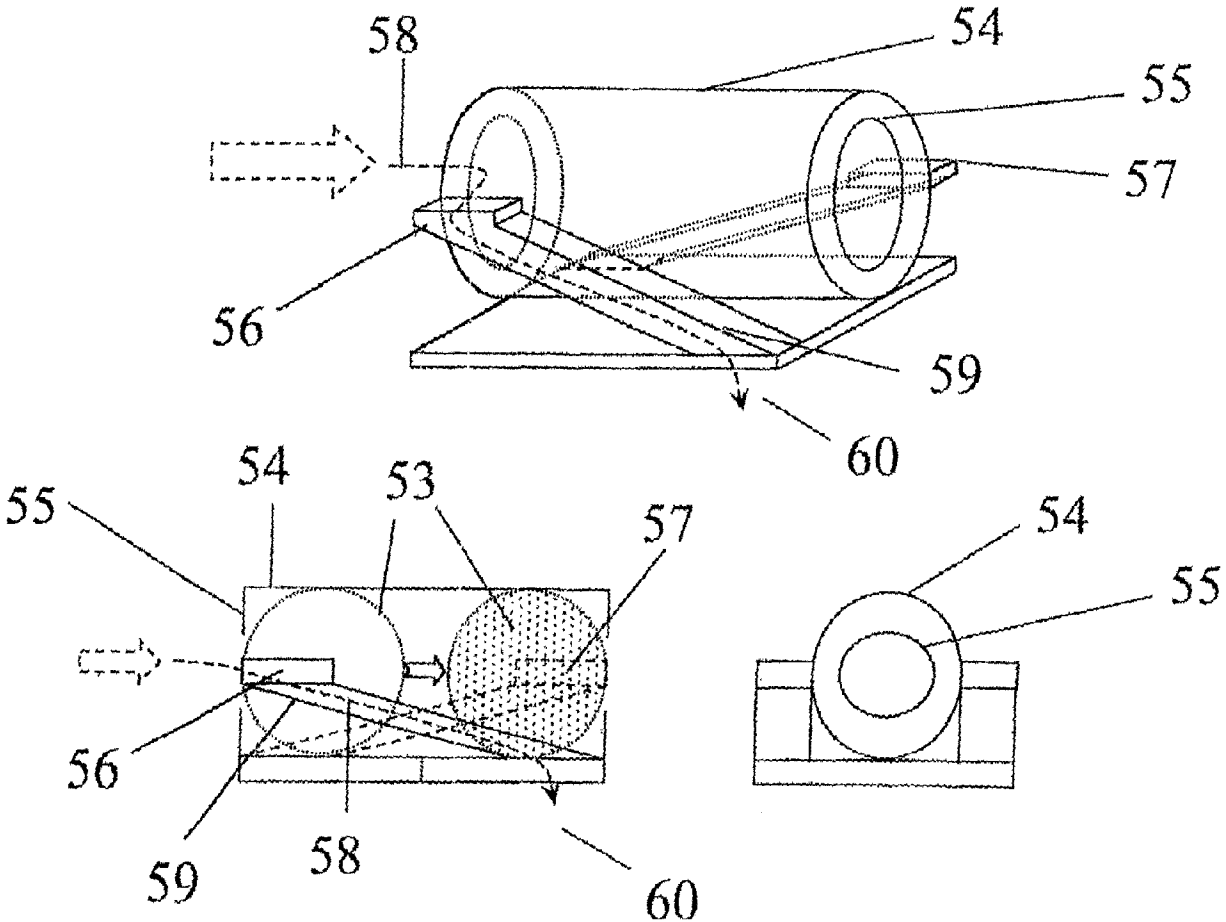
FIG. 21 illustrates a possible air inlet valve for two (opposite) possible explosion wind directions.

FIG. 21 shows an embodiment of an intake valve that can induce suppressant outflow irrespective of the incident direction of the explosion wind. A lightweight ball 53 is enclosed inside a tube 54 that has annular end plates 55 to contain the ball. The wind will drive the ball to the downwind end of the tube thus opening the upwind intake port 56 and closing the downwind air intake port 57. This enables air to flow 58 down the intake channel 59 to the downwind end 60 of the valve from where it can be ducted into the top and/or sides of the container as shown in FIG. 20.

Figure 22:
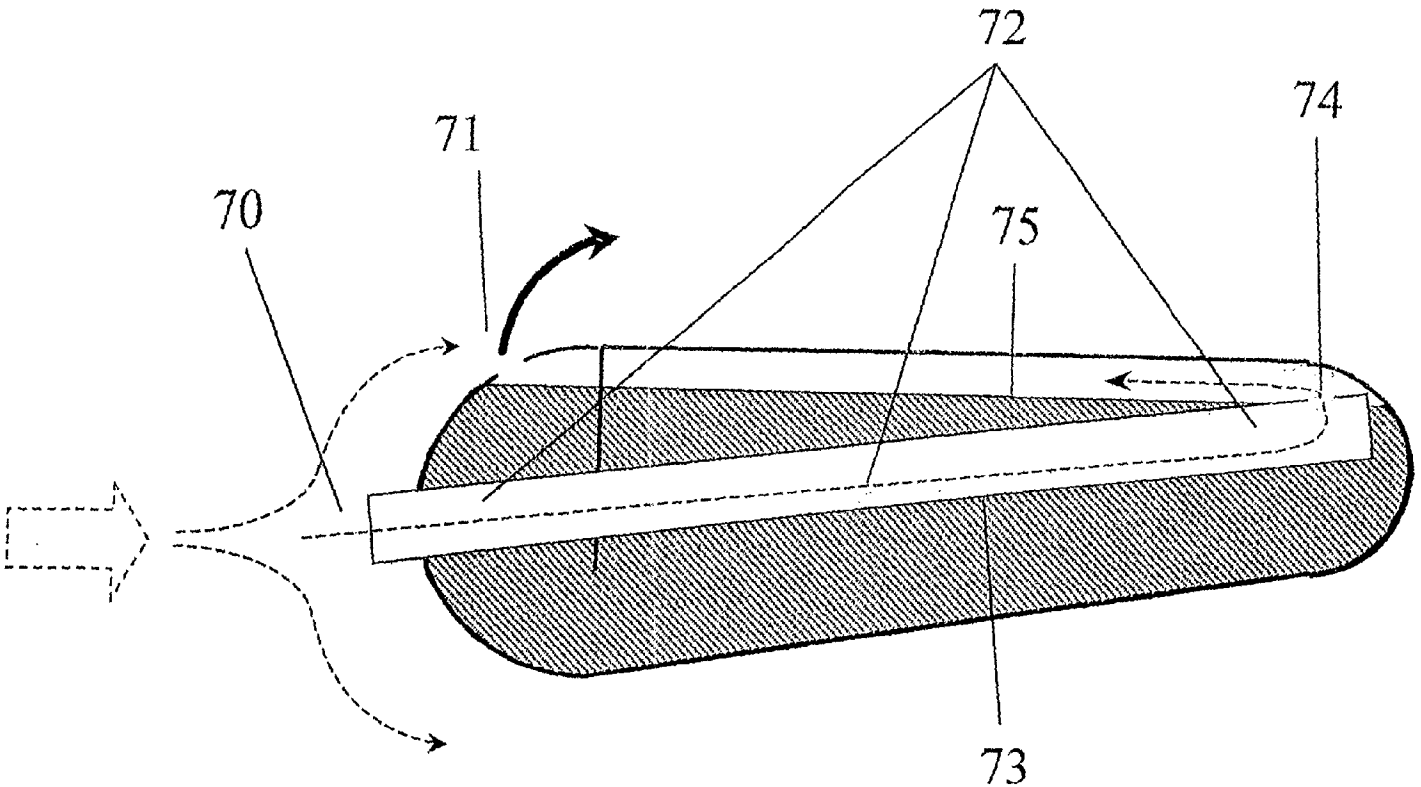
FIG. 22 is similar to FIG. 1 of yet another embodiment of explosion suppressant container within the ambit of the present invention.

FIG. 22 shows an embodiment in which both the air intake at 70 and suppressant outlet at 71 are located on the upstream side of the container. The air route 72 passes from the upstream exterior at 70 to the downstream interior at 74 by way of a channel 73 whose air outlet point at 74 is above the "full-level" of the suppressant at 75. Thus when the container is horizontal it does not empty under the influence of gravity. This embodiment has the advantage that the pressure due to the stagnated air at 70 on the leading edge of the container is communicated to the upper downstream surface of the suppressant where it can act to expel suppressant from the upstream outlet at 71.

Figure 23:
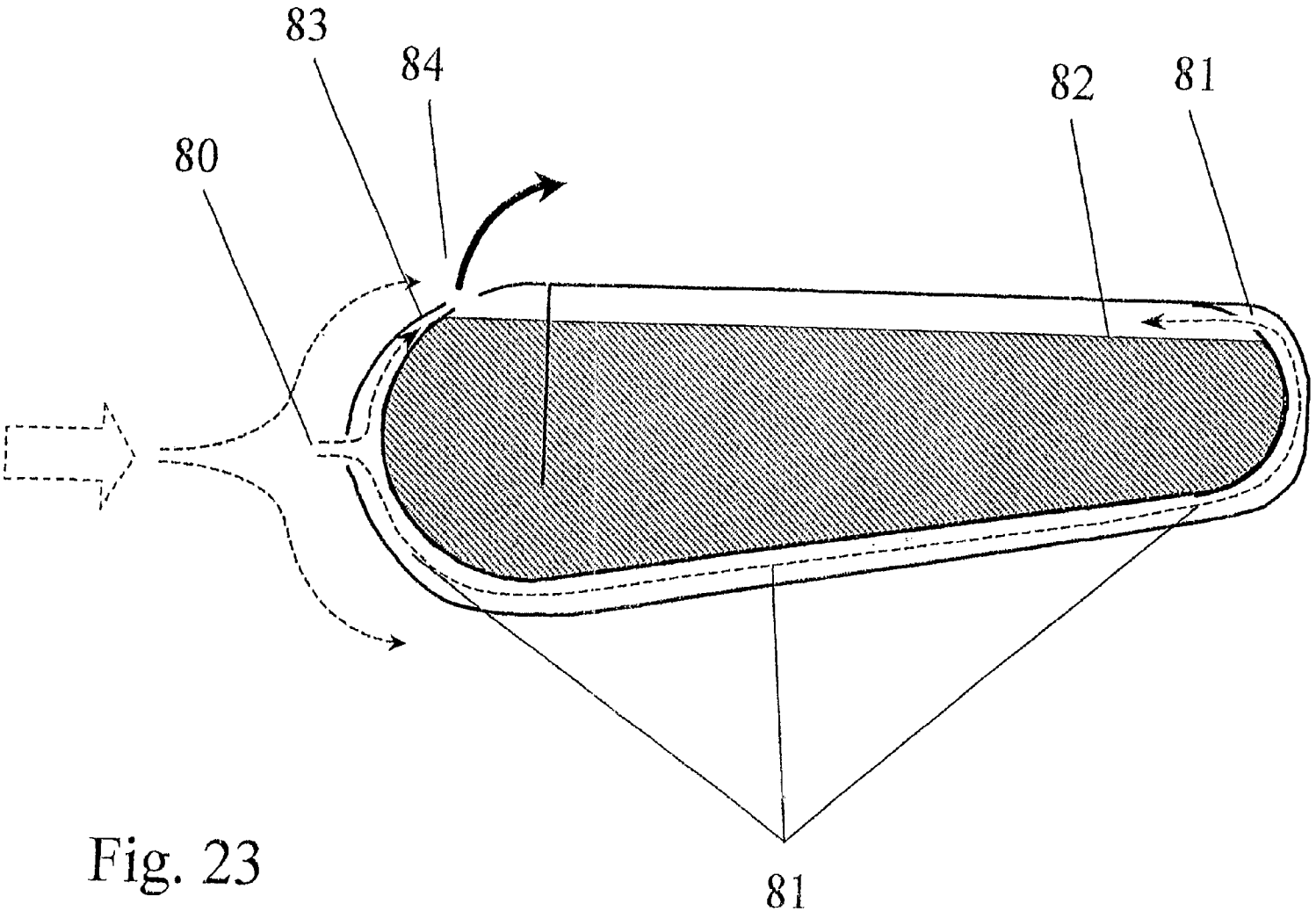
FIG. 23 is a further embodiment of explosion suppressant container.

FIG. 23 shows an embodiment that in common with FIG. 22 has an air intake at 80 on the upstream leading edge from which air can pass through a channel 81 to the rear upper surface of the suppressant at 82. This embodiment also channels the stagnated air at 80 to an outlet at 83 where it interacts with the suppressant outflow at 84 to aid atomisation and dispersal.

Figure 24:
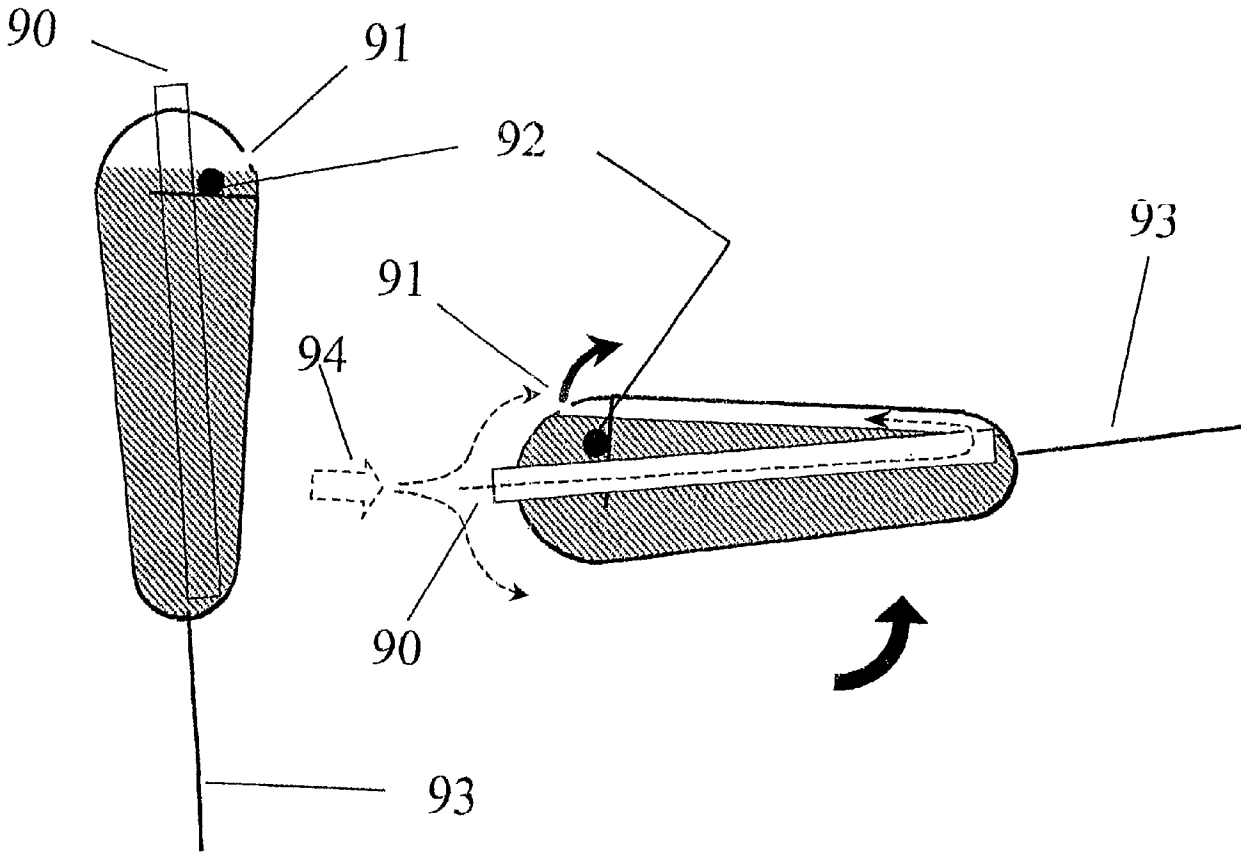
FIG. 24 shows a pivotable container of the type shown in FIG. 22.

FIG. 24 shows an embodiment which combines a container with upstream air inlet at 90 and suppressant outlet at 91, such as shown in FIGS. 22 and 23, which can also rotate (as described in claim 16) about a pivot point at 92 but which also has a "tail-plane" 93. By the principle of a wind vane the tail-plane provides the container with the ability to self-align with the direction of the incident air flow 94 so that the air intake is on the upstream edge and the tail-plane points downstream. The sharp edge of the tail-plane sheds eddies as it rotates which help to damp out oscillations of the container.

Figure 25:
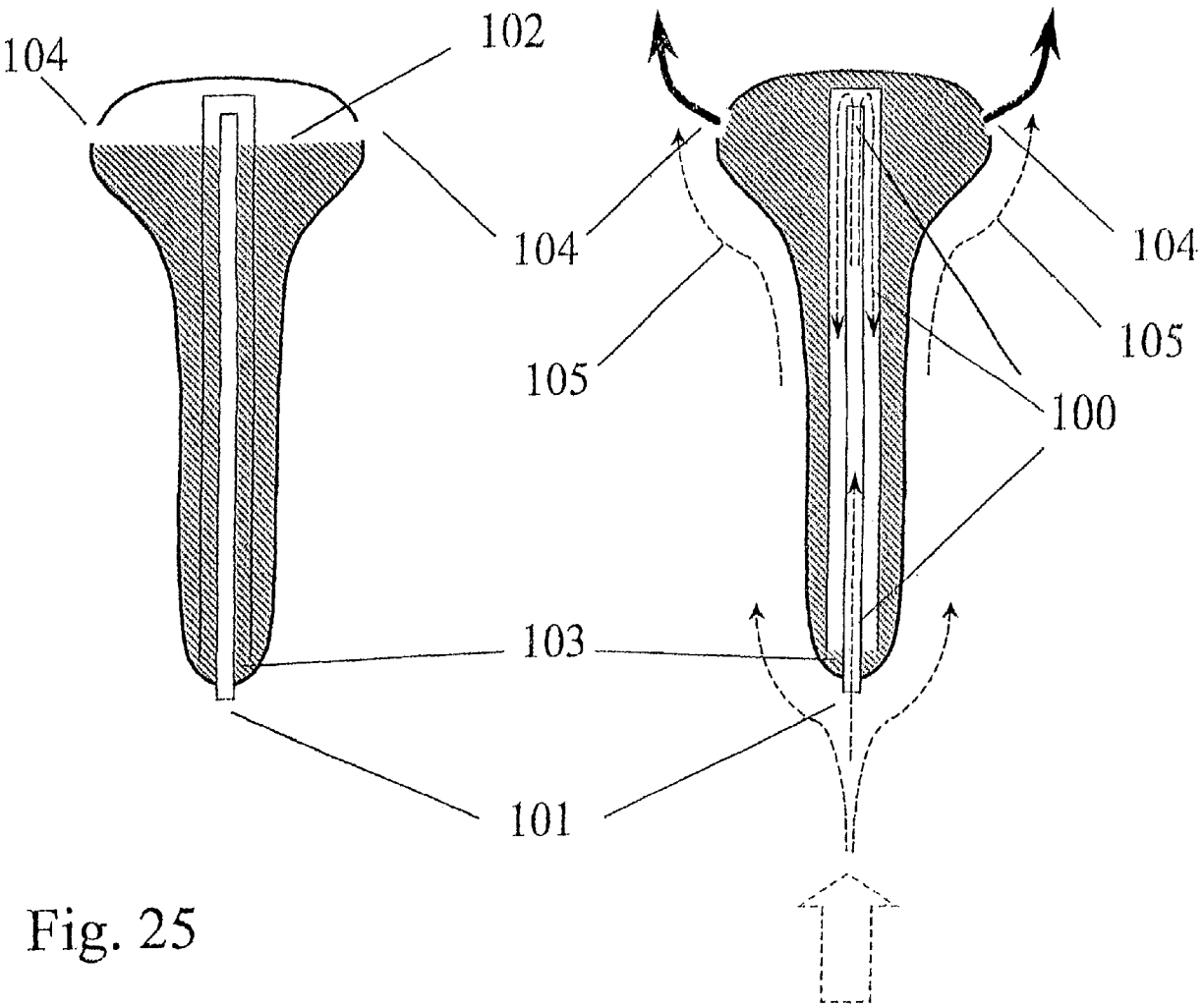
FIG. 25 shows a container arranged for vertical explosion wind direction.

FIG. 25 shows an embodiment for use in suppressing vertically upward propagating flames. It has an air flow route 100 with an air intake on the lower upstream edge at 101 which channels air above the ambient suppressant level at 102 and then downwards to the interior upstream edge at 103 from where it can displace the suppressant so that it flows from the outlet holes on the upper downstream edge at 104. Note that the air route passes above the ambient suppressant level so that suppressant does not drain from the container under ambient conditions. This container shape has its broadest cross-section near to the suppressant outlet holes so that the increase in air velocity caused at 105 by diverting the flow generates a reduction in air pressure at the suppressant hole that aids the expulsion of the suppressant from the container.

Figure 26:
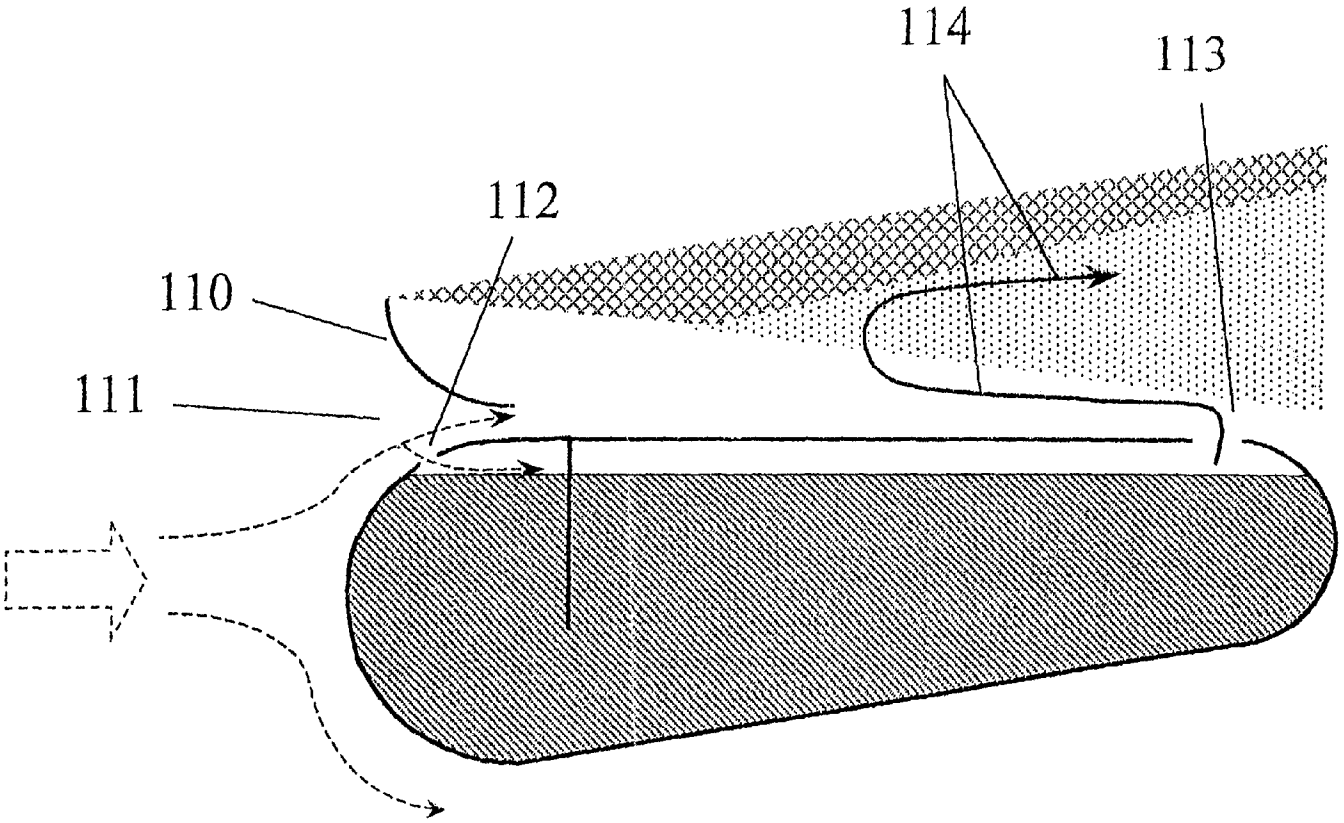
FIG. 26 is similar to FIG. 10, but with the air inlet repositioned.

FIG. 26 shows an embodiment with spoiler or the like at 110 mounted to the external surface of the container similar in description to that in FIG. 3 and claim 10. The position of the spoiler in this case causes a stagnation of the approaching air flow at 111 so that the resulting increase in air pressure acts upon the upstream hole at 112. In addition the spoiler generates a wake flow which contributes to there being a lower pressure at the downstream hole at 113 compared to that at the upstream hole 112. The net effect is that suppressant 114 is drawn from the downstream hole where it is atomized.

Figure 27:
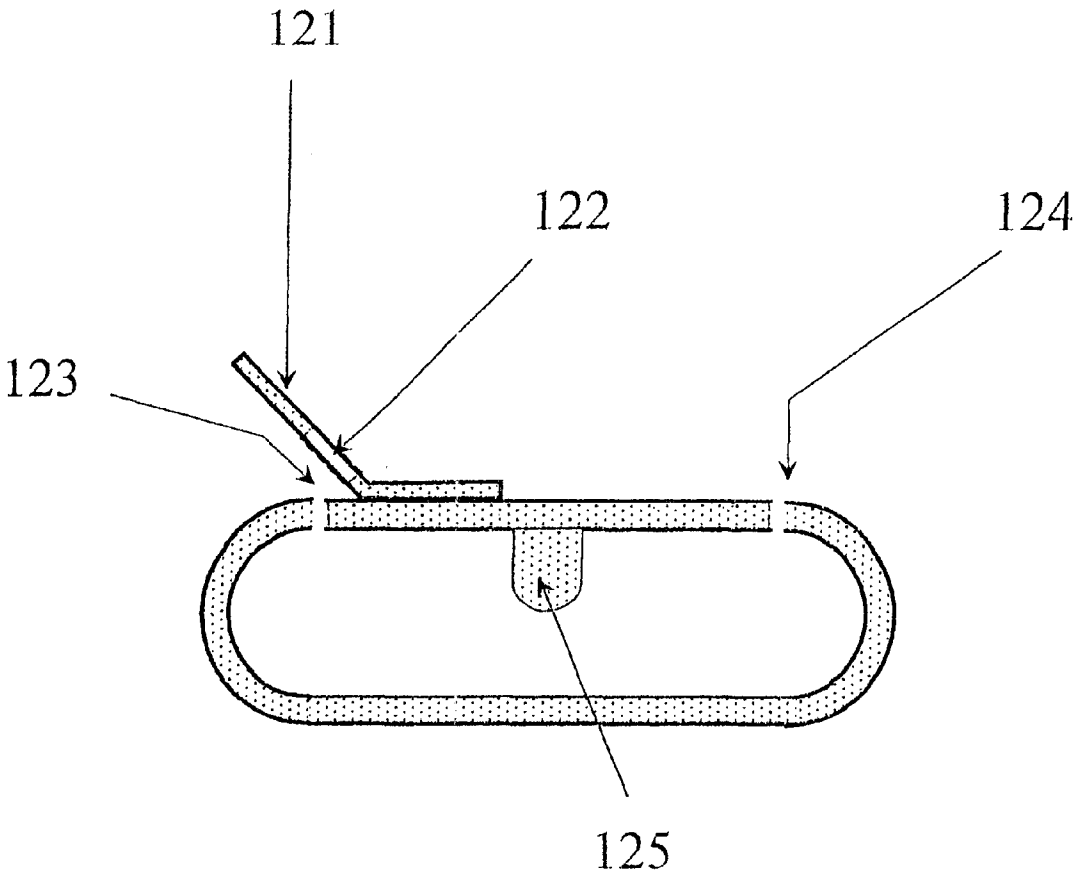
FIG. 27 is a cross-sectional view of a further embodiment of container.

FIG. 27 shows a cross-section of a container as shown in FIG. 26, in which the spoiler at 121 takes the form of an angled plate with a row of holes 122. The spoiler is placed adjacent to the air inlet holes 123 at the opposite side of the container to the suppressant outlet holes 124. The internal flow guide at 125 is shown as a rounded bar.

Figure 28:
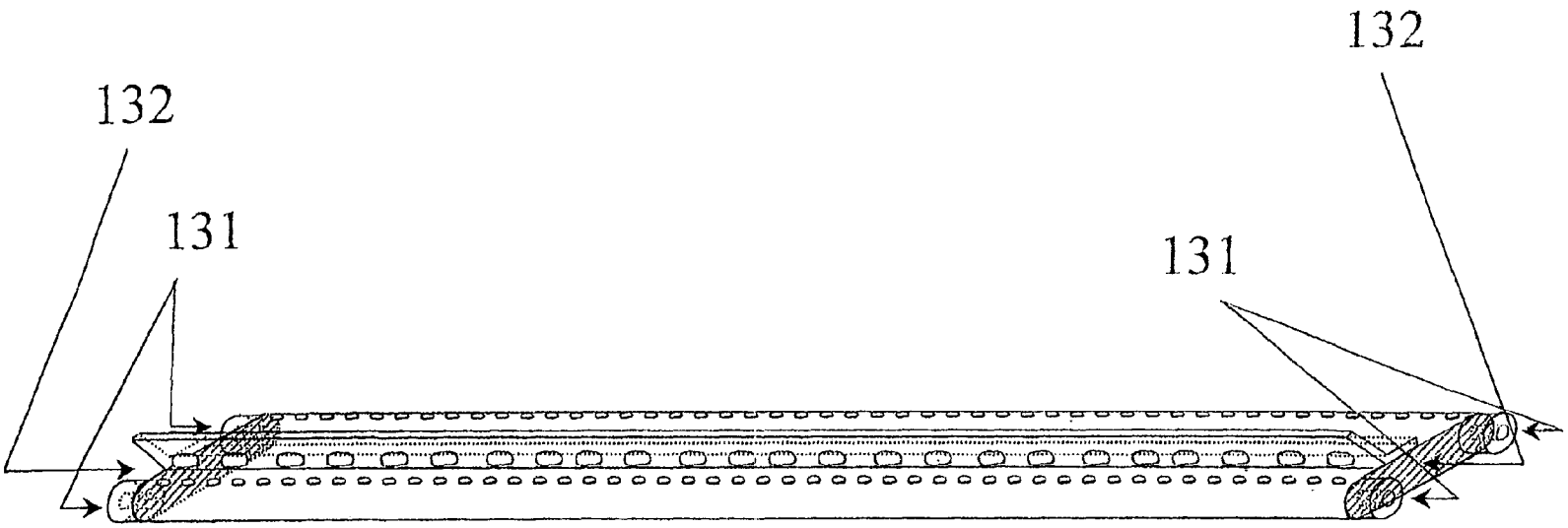
FIG. 28 shows a still further embodiment of a container.

FIG. 28 is a perspective view of the embodiment shown in FIG. 27, with suppressant inlet and outlet end-holes at 131, as described above with reference to FIG. 13. The end-holes take the form of hollow studs attached to the otherwise closed ends 132 of the container.

The invention claimed is:

1. Explosion suppressant container, for use in suppression of events involving combustion associated with rapidly moving gases, comprising:

an elongated container body which, in use, contains containing suppressant, the container body being elongated in a direction of an explosion wind from an explosion, an outlet through which suppressant can exit the container progressively and be atomized into droplets, and an inlet through which air can enter the container, wherein said outlet is on or near a leading edge of the container, wherein said inlet on or near a trailing edge of the container and is spatially offset from the outlet, and wherein the leading edge of said container is arcuate in shape, such that, in use, the pressure of the explosion wind in the region of the outlet is less than that in the region of the inlet so that suppressant is driven out of the outlet into the explosion wind.

2. Container according to claim 1 further comprising an air flow inhibitor for inhibiting air flow within the body between said outlet and said inlet, wherein the container is also elongated in a second dimension perpendicular to the direction of flow of the explosion wind, wherein the container body dimension in the direction of flow of the explosion wind and the second dimension are elongated with respect to a third dimension perpendicular to the direction of flow and to the second dimension, and wherein, at the inlet, air pressure is relatively low in the explosion wind and, at the outlet, air pressure is relatively high in the explosion wind.

3. Container according to claim 2 further comprising a flow guide within the body for determining the flow route of suppressant within the body and wherein the flow guide and air flow inhibitor are integral with one another.

4. Container according to claim 3 wherein the flow guide comprises a channel, spout or the like depending from the outlet into the body below the normal surface level of suppressant.

5. Container according to claim 2 wherein the flow guide comprises a baffle plate depending from the internal surface of the body below the normal surface level of suppressant.

6. Container according to claim 1 having a plurality of outlets and/or inlets.

7. Container according to claim 6 in which one or more of said outlets can serve as one or more of said inlets.

8. Container according to claim 7 in which the body is substantially symmetrical in cross-section about a plane intermediate said outlet and said inlet, thus enabling the container to respond to an explosion wind approaching from either end of the container.

9. Container according to claim 1 further comprising a spoiler or the like mounted on the external surface of the container in order to enhance the dispersal and/or mixing and/or atomisation of suppressant exiting the container.

10. Container according to claim 1 whose external shape includes a step or the like which, in use, increases turbulence and generates a shear layer in the explosion wind which enhances the dispersal and mixing of the suppressant.

11. Container according to claim 1 in which the inlet and/or outlet is covered by a friable membrane which normally retains suppressant in the container but which ruptures when exposed to an explosion wind to allow suppressant to exit the container.

12. Container according to claim 1 in which the body further comprises flexible or moving parts therein whose position changes as suppressant is drawn from the container so as to regulate the suppressant flow, and wherein said flexible or moving parts comprise a valve arrangement and a pivotable plate.

13. Container according to claim 1 wherein the container is rotatable under the influence of the forces exerted by the explosion wind so as to orientate the inlet and outlet with respect to the explosion wind.

14. Container according to claim 13 which, in the absence of explosion wind, is oriented so that the suppressant is below the level of the outlet and is retained within the body by means of a valve at the inlet, the valve being opened when the container is rotated by the forces exerted by the explosion wind to allow air into and hence suppressant out of the body.

15. Container according claim 1 further comprising suppressant supply inlets and/or outlets which enable the suppressant to be topped up and/or replenished and/or forced into the body.

16. Container according to claim 1 wind wherein, when compared to a third dimension of the container body, a first dimension of the container body is elongated, wherein, when compared to the third dimension, a second dimension of the container body is elongated, wherein the first dimension is in the direction of flow of the explosion wind, and wherein the second and third dimensions are perpendicular to the direction of flow and to one another.

17. Container according to claim 16 which has an internal partition confining suppressant to an upwind end of the body, and linking the air inlet to the suppressant, whereby the flow path for suppressant is shorter.

18. Container according to claim 1 in which cowlings are disposed around the air inlet to create stagnant air in an explosion wind.

19. Container according to claim 18 in which said outlets are in front of and offset laterally with respect to said inlets to prevent suppressant exiting the outlet from entering the inlets.

20. Container according to claim 1 in which the body is shaped behind the outlet to increase the surface area of the body downwind of the outlet so as to increase suppressant atomization rate.

21. Container according to claim 20 in which said body is undulating with ridges formed behind and extending from the or each outlet.

22. Container according to claim 1 which has a funnel connected to the inlet.

23. Container according to claim 22 in which said funnel is relatively large, there being provided a plurality of outlets along the breadth of the container being supplied with inlet air by said funnel.

24. Container according to claim 22 in which said funnel comprises an open ended tube whose ends face in two possible directions of anticipated explosion wind, a member being displaceable in said tube to open and close ports adjacent each end of the tube in dependence upon said explosion wind direction, the ports each supplying a duct to said inlet.

25. Container according to claim 1 further comprising an air flow inhibitor for inhibiting air flow within the body between said outlet and inlet and a conduit from said inlet at a stagnant region of the container for an anticipated explosion wind, said conduit connecting said region with an internal space of the body above said suppressant and on the side of said air flow inhibitor remote from the outlet.

26. Container according to claim 25 in which said conduit has a branch terminating at said outlet and arranged to direct air across the outlet in an explosion wind to assist atomisation of the suppressant exiting the outlet.

27. Container according to claim 13 in which said container is pivoted about a horizontal axis and is provided with a tail plane to align with an explosion wind from a direction radial with respect to said axis, and wherein both the inlet and outlet are above suppressant level when in a normal attitude in no explosion wind.

28. Container according to claim 1 which further comprises a conduit from said inlet at a stagnant region of the container for an anticipated, vertically upward, explosion wind, said conduit connecting said region with an upper internal space of the body, which space is above said suppressant in the absence of an explosion wind, a closed cup surrounding said conduit and opening in a lower internal space of the body, said outlets opening from the upper internal space.

29. Container according to claim 9 in which the inlet is on a leading edge of the body in a stagnant space for an anticipated explosion wind and caused by the spoiler.

30. Apparatus for use in suppressing events involving combustion associated with rapidly moving gases comprising a plurality of explosion suppression containers as claimed in claim 1.

31. Apparatus according to claim 30 wherein the containers are arranged in an array so as to optimise the overlap and mixing of suppressant exiting adjacent containers.

32. Apparatus according to claim 30 in which the array of containers is mounted within a frame.

33. Apparatus according to claim 30 further comprising aerodynamically smooth guide means which converge the explosion wind on approaching the containers so as to increase velocity of gas passing the containers.

34. Apparatus according to claim 30 further comprising turbulence-generating means which enhance the dispersal and mixing of the suppressant and thereby the suppressant capability of the apparatus.

35. Apparatus according to claim 34 wherein said turbulence-generating means have a bluff downwind profile.

36. Apparatus according to claim 30 further comprising a friable wall within which the array of containers is mounted and which friable wall can be ruptured, in use, by the explosion wind.

37. Apparatus according to claim 30 further comprising a suppressant circulation system for supplying suppressant to the containers.

38. Apparatus according to claim 37 in which the suppressant circulation system includes one or more reservoirs outside the containers where suppressant can collect.

39. Apparatus according to claim 37 wherein the array of containers is mounted within a frame and said suppressant circulation system is mounted within said frame.

40. Apparatus according to claim 39, wherein said frame contains a series of cascades down which suppressant can fall under gravity and thereby provide a slow replenishment flow.

41. A method for suppressing an explosion, comprising:

(a) providing a container body containing a suppressant, an outlet for the suppressant, and an air inlet;

(b) contacting, with the container body, an explosion wind associated with an explosion, wherein a pressure of the explosion wind in the region of the outlet is less than a pressure of the explosion wind in the region of the inlet, whereby suppressant is driven progressively out of the outlet into the explosion wind; and (c) thereafter contacting, with the expelled suppressant, a flame associated with the explosion, wherein the expelled suppressant reduces a rate of combustion of the flame and/or cools combustion products of the flame.

42. The method of claim 41, further comprising:

contacting, with the first wind, the outlet and second the inlet and wherein the container body comprises an arcuate leading edge, the leading edge being near the outlet, and a trailing edge, the trailing edge being near the inlet.

43. The method of claim 42, wherein the trailing edge has a curved shape.

44. The method of claim 41, further comprising:

positioning the inlet where an air pressure of the explosion wind is relatively low; and positioning the outlet where an air pressure of the explosion wind is relatively high.

45. The method of claim 41, wherein the container body is elongate, the container body having an elongate lateral cross-section, and wherein the suppressant is atomized by the outlet.

* * * * *